United States Patent [19]

Benson

[11] Patent Number: 4,488,853

[45] Date of Patent: Dec. 18, 1984

[54] FLUID PRESSURE RATIO TRANSFORMER SYSTEM

[75] Inventor: Glendon M. Benson, Danville, Calif.

[73] Assignee: New Process Industries, Inc., Minneapolis, Minn.

[21] Appl. No.: 360,094

[22] Filed: Mar. 19, 1982

Related U.S. Application Data

[63] Continuation-in-part of Ser. No. 182,185, Aug. 28, 1980, abandoned, which is a continuation of Ser. No. 937,904, Aug. 29, 1978, abandoned.

[51] Int. Cl.[3] ..... F04B 17/00

[52] U.S. Cl. ..... 417/240; 417/340; 417/383; 417/392

[58] Field of Search ..... 417/240, 340, 375, 383–388, 417/379, 392, 467, 469; 60/520, 579, 593; 92/66

[56] References Cited

U.S. PATENT DOCUMENTS

| | | | |
|---|---|---|---|
| Re. 27,740 | 8/1923 | Schuman | 417/379 X |
| 776,106 | 11/1904 | Beurrier | 417/379 X |
| 1,271,712 | 7/1918 | Humphrey et al. | 417/383 X |
| 2,490,118 | 12/1949 | Dickinson | 417/383 |
| 2,752,854 | 7/1956 | Prior et al. | 417/388 |
| 2,807,215 | 9/1957 | Hawxhurst | 417/388 |
| 3,065,703 | 11/1962 | Harman | 417/384 X |
| 3,107,406 | 2/1965 | Robertson | 417/384 X |
| 3,339,464 | 9/1967 | Rietdijk | 417/383 X |
| 3,482,401 | 12/1969 | Waite | 60/579 |
| 3,513,659 | 5/1970 | Martini | 417/383 X |
| 3,645,649 | 2/1972 | Beale | 417/379 |
| 3,885,393 | 5/1975 | Hanson | 417/383 X |
| 3,986,360 | 10/1976 | Hagen et al. | 60/520 |

FOREIGN PATENT DOCUMENTS

| | | | |
|---|---|---|---|
| 1228235 | 8/1960 | France | 417/384 |
| 702331 | 1/1954 | United Kingdom | 417/469 |

*Primary Examiner*—Leonard E. Smith
*Attorney, Agent, or Firm*—Townsend & Townsend

[57] ABSTRACT

A fluid pressure ratio transformer which may be utilized to couple pressure variations in a working fluid operating at a given input pressure ratio to a fluid coupled load operating at a different required output pressure ratio. The device is self-modulating to pump-load, whether operating at fixed stroke or fixed frequency. The pressure ratio transformer comprises a housing and a positive displacement element within the housing dividing the housing interior into first and second chambers, each of which is filled with a compressible fluid. The working fluid in the first chamber is subjected to periodic pressure oscillations while the fluid in the second chamber is either coupled to a fluid load or may itself be the pumped fluid. The effective spring coefficients and the mass of the piston are matched to the frequency of operation so that the piston oscillates at its natural frequency. The displacement element operates as in inertial resonant compressor capable of producing the needed pressure ratio transformation (typically pressure ratio amplification) between the two chambers.

14 Claims, 36 Drawing Figures

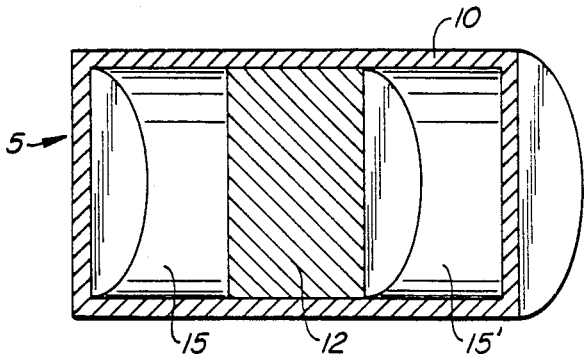
FIG._IA. BACKGROUND
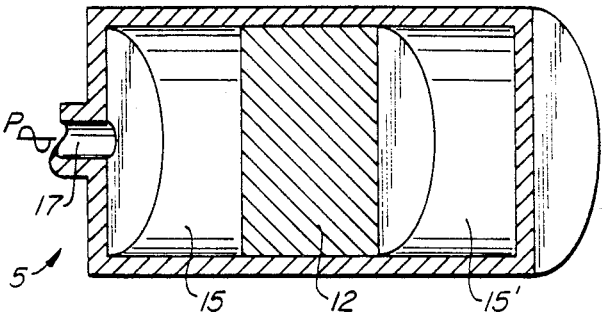
FIG._IB. BACKGROUND
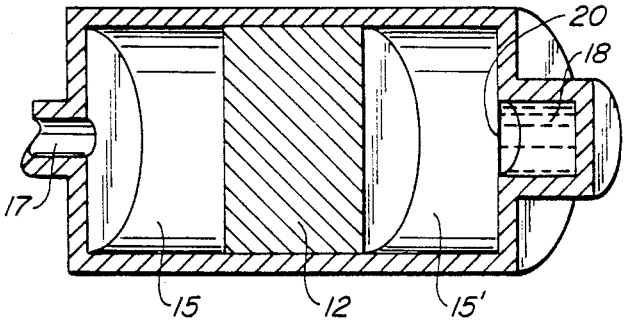
FIG._IC. BACKGROUND
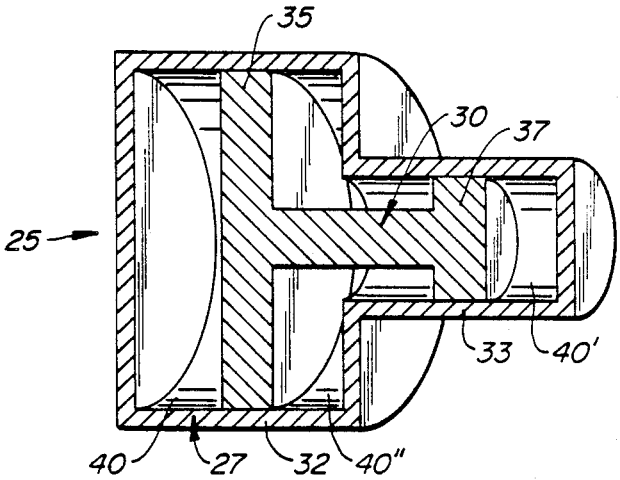
FIG._ID. BACKGROUND

FLUID PRESSURE RATIO TRANSFORMER SYSTEM

This application is a continuation-in-part of co-pending application Ser. No. 182,185, filed Aug. 28, 1980, now abandoned, which is itself a continuation of application Ser. No. 937,904, filed Aug. 29, 1978, now abandoned.

FIELD OF THE INVENTION

This invention relates generally to fluid-mechanical machines, and more specifically to such a machine which couples periodic pressure variations in a first fluid circuit to a second fluid circuit.

BACKGROUND OF THE INVENTION

In energy conversion and power transmission it is often necessary or desirable to convert the pressure ratio of pressure oscillations of one fluid circuit to a higher or lower value in a coupled fluid. For example, if the pressure ratio of a first fluid circuit equals 2.0, the pressure ratio of the coupled fluid may need to be increased to 8.0 or reduced to 0.5 for meeting a particular requirement. The virtues of pressure ratio amplification may be illustrated by considering first an air compressor and then a hydraulic pump application.

It should be noted that there are several ways to describe a situation where a working fluid operates between two extremes in pressure ($P_{min}$ and $P_{max}$). For example, one can use $P_{min}$ and $P_{max}$, or alternately the mean pressure ($(P_{min}+P_{max})/2$) and the pressure amplitude ($(P_{max}-P_{min})/2$). The remaining discussion in this application will be in terms of a third pair of variables, the pressure ratio ($P_{max}/P_{min}$) and the mean pressure.

A typical crankshaft-driven reciprocating air compressor compresses air of atmospheric pressure (14.7 psia) to 100 psig (114.7 psia) discharge pressure, thereby operating at a pressure ratio of (114.7/14.7) or 7.80. However, if a particular application required a discharge pressure of 300 psia, this compressor could not be used since the crank bearing and drive motor would be overloaded. Alternately, if a discharge pressure of 30 psig were required at 3 times the rated cfm of the compressor, either three identical compressors or a new compressor would be required. Thus, the compressor that had been designed for operation at a pressure ratio of 7.80 is seen to be incapable of operating at a higher pressure ratio (21.41) and has insufficient capacity when the demand is at a lower pressure ratio (3.04).

The second example involves a free piston engine driving a hydraulic pump which is used to power a hydraulic motor. A typical free piston engine might employ a working gas operating between pressures of 200 and 400 psia (pressure ratio of 2.0). The engine working gas operates on a diaphragm which separates it from the pumped hydraulic fluid. To provide a long lifetime for the diaphragm, the respective pressures on both sides of the diaphragm must be equal at any instant of time. As a result, the hydraulic fluid pressure equals the working gas pressure, and the hydraulic fluid must be discharged at an outlet pressure of 400 psia and admitted at an inlet pressure of 200 psia. That is, the pump pressure chamber operates at the same pressure ratio of 2.0. Thus, if the hydraulic motor is to be matched to the pump output, the motor would properly operate with a 200 psi pressure differential across it. However, the hydraulic motor may be smaller and lighter if it operates with a supply pressure of 4000 psia and a discharge pressure of 50 psia. This would require that the pump (and also the engine) provide a pressure ratio of $4000/50=80$. However, no known free piston engine is capable of operating at such a high working gas pressure ratio.

One possible way of providing the required 4000 psia pressure for the motor would be to add a pressure intensifier between the existing engine driven diaphragm pump and the hydraulic motor. The intensifier, for example, could comprise a stepped piston with mating bores where the smaller of the bores (the high pressure side) had a cross-sectional area one-tenth that of the larger diameter low pressure bore. This intensifier would increase the pump output pressure from 400 to 4000 psia, but unfortunately, it would also increase the pump inlet pressure from 200 to 2000 psia which is far from the required 50 psia. Thus, since pressure intensifiers amplify pressure, but not pressure ratio, they cannot be used for this specific application.

In the two examples described above, wherein a fluid coupled load required a pressure ratio that differed from that available from the working gas, it was nevertheless assumed that the requirement was a constant one. The actual situation is likely to be even worse, since many applications are characterized by an output pressure ratio requirement that varies over a range. For example, a pressure reservoir is usually pumped up from a low pressure to a high pressure, so that the pump load exhibits a variable pressure ratio. Such is the case when an air compressor is used to pressurize an air tank or a hydraulic pump is used either to pressurize an accumulator or to supply a hydraulic motor subject to variable torque load.

The problems discussed above have generally been accepted as inevitable, with the consequence that many sources of pressure oscillation have been ignored for wide classes of applications. For example, while free-piston Stirling engines may be attractive for a variety of reasons, their operating characteristics make them ill-suited for pumping hydraulic fluid to power a hydraulic motor. Accordingly, while not heretofore well recognized, there is presented the need for a device and method that provide pressure ratio transformation in fluid circuits. The situation is exacerbated by the additional factor that the required transformation ratio is often determined by the instantaneous load characteristics.

SUMMARY OF THE INVENTION

The present invention provides a fluid pressure ratio transformer which may be utilized to couple pressure variations in a working fluid operating at a given input pressure ratio to a fluid coupled load operating at a different required output pressure ratio. The device is self-modulating to pump-load, whether operating at fixed stroke or fixed frequency.

Broadly, a pressure ratio transformer according to the present invention comprises a housing and a positive displacement element within the housing. The positive displacement element may be a piston which reciprocates within the housing and divides the housing interior into first and second chambers, each of which is filled with a compressible fluid. The working fluid in the first chamber is subjected to periodic pressure oscillations while the fluid in the second chamber is either coupled to a fluid load or may itself be the pumped fluid. The effective spring coefficients and the mass of the piston are matched to the frequency of operation so that the piston oscillates at its natural frequency. Damping caused by fluid friction and pumped fluid head varies the phase of the pressure oscillations in the working fluid in the first chamber and the fluid in the second chamber relative to the phase of the displacement of the oscillating piston. The piston is configured so that the frictional component of the overall damping coefficient is small. The additional component of the damping coefficient due to loading is kept at a sufficiently low level that the overall damping is small and the system is highly tuned with the resonant frequency being highly insensitive to changes in the load. The piston operates as an inertial resonant compressor capable of producing the needed pressure ratio transformation (typically pressure ratio amplification) between the two chambers.

The oscillating piston may take the form of a stepped piston having differential areas subjected to the pressure oscillations in the first chamber and the pressure oscillations induced in the second chamber. This allows further manipulation of the spring coefficients to permit a reduction in the stroke range that a pressure transformer must operate over in meeting changes in pressure ratio in the pump load while maintaining constant frequency of operation.

Not only is the present invention capable of coupling the pressure oscillations in one fluid to those of another with a desired increase or a decrease in pressure ratio, but it is also capable of load matching the two fluids. For example, in a system that operates at fixed frequency, an increase in required output pressure ratio as dictated by a change in load requirements causes the piston stroke to increase automatically in such a manner as to match the new load. In a like manner, if the stroke were fixed, the frequency would increase to match the higher pump pressure ratio required.

For a further understanding of the nature and advantages of the present invention, reference should be made to the following specification and accompanying drawings.

BRIEF DESCRIPTION OF THE DRAWINGS

FIGS. 1A–D are sectioned oblique views illustrative of resonant oscillators that are incapable of producing pressure ratio amplification;

DETAILED DESCRIPTION OF THE INVENTION

Discussion of Hypothetical Structures

Figure 2:
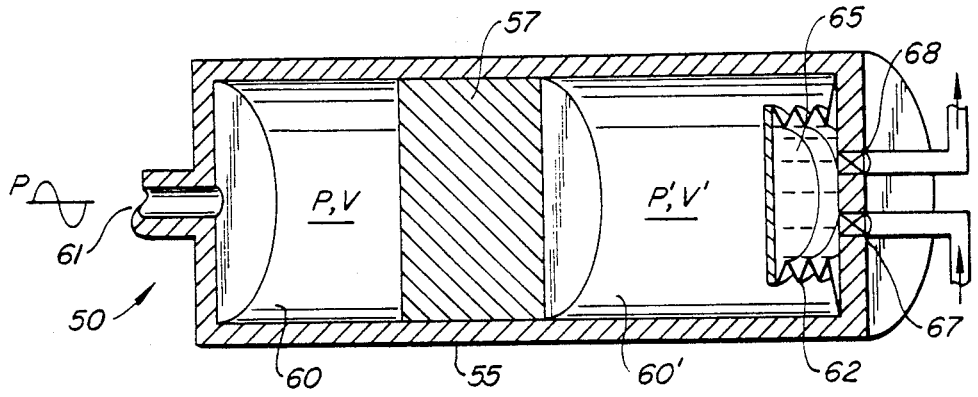
FIG. 2 is a sectioned oblique view of a pressure ratio transformer according to the present invention for pumping hydraulic fluid.

Prior to discussing the resonant oscillator of the present invention and the pressure ratio amplification produced thereby, it is helpful to discuss a variety of hypothetical structures that, while structurally similar, do not operate as resonant oscillators capable of producing pressure ratio amplification.

Consider first a simple hypothetical resonant oscillator 5 illustrated in the sectioned oblique view of FIG. 1A. Oscillator 5 comprises an enclosed cylindrical housing 10 having a symmetrically located piston 12 that divides the interior of housing 10 into a first chamber 15 and a second chamber 15'. Each of chambers 15 and 15' contains a compressible fluid, and in order that piston 12 experience no net motion, it may be assumed that the respective mean pressures in chambers 15 and 15' are equal. When piston 12 is set into free oscillation, it reciprocates at a given frequency determined by the mass of piston 12 and the effective spring coefficient tending to restore piston 12 to its central position. The spring coefficient is determined by a variety of factors including the fluid pressures. Owing to symmetry, the maximum pressure excursions from the mean pressure are the same in both chambers, and hence the respective pressure ratios in the chambers are equal. That is, resonant oscillator 5 produces no pressure ratio amplification.

The simple resonant oscillator of FIG. 1A may be modified as shown in FIG. 1B by communicating to the interior of chamber 15 a conduit 17 to which a source of pressure oscillation is communicated. An example of such a pressure source could be a piston operating in chamber 15 or in a chamber in fluid communication therewith. The source of pressure oscillation is such as to maintain the same mean pressure, amplitude of pressure oscillation, and frequency of pressure oscillation as in the case of FIG. 1A. Piston 12 now reciprocates at the same frequency and produces the same mean pressure and pressure ratio in chamber 15' as in the case of the free oscillation of the device in FIG. 1A. This example illustrates that in a conventional resonant reciprocator driven by an external source of pressure oscillation no pressure ratio amplification is obtained, even though the piston reciprocates at its natural frequency.

Consider yet a further modification as illustrated in FIG. 1C wherein the resonant oscillator is further provided with a chamber 18 separated from chamber 15' by a diaphragm seal 20. Chamber 18 is filled with hydraulic fluid. When piston 12 is reciprocated at its natural frequency, as for example under the influence of pressure oscillations provided through conduit 17, a pressure oscillation in the hydraulic fluid is produced. Since diaphragm 20 is pressure balanced, the respective pressures on both sides of the diaphragm are equal at any instant. Therefore, the hydraulic fluid experiences the same mean pressure and pressure ratio as those in chamber 15' which are, as discussed above, the same as those in chamber 15.

FIG. 1D shows a simple resonant mechanical oscillator 25 having a stepped piston configuration. Oscillator 25 includes a housing 27 and a dumbbell-shaped piston 30 within the housing. Housing 27 has a first large diameter portion 32 and a second smaller diameter portion 33. Piston 30 has large and small diameter portions 35 and 37 reciprocating within the respective bores defined by housing portions 32 and 33. This defines a first large diameter chamber 40, a second small diameter chamber 40', and a third central chamber 40'' having portions of both diameters. Assume that piston 30 is centered when the pressures in chambers 40 and 40' are equal (also equal to the pressure in chamber 40''). Upon setting piston 35 into free oscillation, the piston will reciprocate at a given frequency determined by the mass of the piston and the effective spring coefficient as defined by the fluid pressures. Owing to symmetry and the stepped piston design, the pressure ratios in chambers 40, 40', and 40'' are equal. Therefore, as with the first three examples above, this configuration of resonant oscillator does not provide pressure ratio amplification.

Consider also a variation of the system of FIG. 1D wherein central chamber 40'' is vented and the mean pressure of fluid in chamber 40' is increased over that in chamber 40 by the ratio of the bore cross sections so that the midstroke position is at equilibrium. Upon setting piston 35 into free oscillation, the piston reciprocates at its natural frequency and the pressure ratio of the pressure oscillations in chambers 40 and 40' are equal. Therefore, the configuration with vented mid-chamber, while providing pressure intensification in chamber 40' relative to that in chamber 40, produces no pressure ratio amplification.

OVERVIEW OF THE PREFERRED EMBODIMENTS

FIG. 2 is a sectioned oblique view of a pressure ratio transformer system 50 that transforms pressure oscillations at an input pressure ratio into pressure oscillations at an output pressure ratio suitable, for example, for pumping hydraulic fluid at a higher required output pressure ratio. Transformer system 50 includes a generally tubular housing 55 with a cylindrical flywheel piston 57 therein which divides the interior of housing 55 into a first chamber 60 and a second chamber 60'. A source of pressure oscillations communicates to chamber 60 via a conduit 61. A bellows 62 is mounted to an end wall 63 of chamber 60', and defines therewith a pump chamber 65 having inlet and outlet check valves 67 and 68. In the discussion that follows, a reference to chamber 60' will be taken to mean that volume within housing 55 that is on the side of piston 57 remote from chamber 60 and exterior of bellows 62. For definiteness, let the state variables of pressure and volume for chamber 60 be denoted by P and V; those for chamber 60' by P' and V'; those for pump chamber 65 by $P_P$ and $V_P$. Chambers 60 and 60' are each filled with a compressible fluid, which may be a gas such as hydrogen, air, or nitrogen, or a vapor such as a fluorinated hydrocarbon ("Freon"). The compressible fluids will hereinafter be referred to as gases, even though they may be vapors. They may be the same as each other, or different. Pump chamber 65 is filled with an incompressible fluid, typically hydraulic fluid. The fluid (gas) in chamber 60 will sometimes be referred to as the working fluid (gas) and that in chamber 60' as the bounce fluid (gas).

Figure 3:
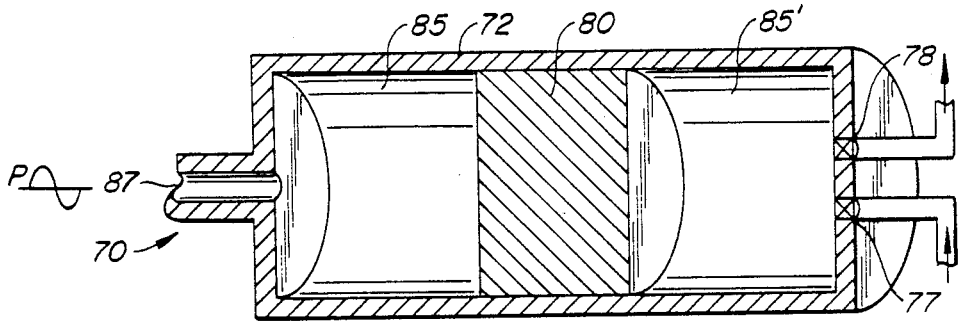
FIG. 3 is a sectioned oblique view of a pressure ratio transformer according to the present invention for compressing gas.

FIG. 3 is a sectioned oblique view of a pressure ratio transformer system 70 that transforms pressure oscillations at an input pressure ratio into pressure oscillations at a different pressure ratio. Transformer 70 comprises a generally tubular housing 72 having a fluid pressure inlet 75 at a first end and check valves 77 and 78 at a second remote end. A flywheel piston 80 divides the interior region of the housing into a first chamber 85 and a second chamber 85'. Pressure oscillations are communicated to chamber 85 via a conduit 87. The fluid in chamber 85' is the pumped fluid which is admitted at inlet check valve 77 at a low pressure and discharged at outlet check valve 78 at a high pressure with a pressure ratio that has been amplified to a desired value (typically higher).

OPERATION OF THE INVENTION

The present invention provides pressure ratio amplification (or transformation) by the mechanism of inertial compression. The system is tuned to run resonantly, and the piston stroke (or frequency) can change to accommodate variations in the load.

While the best control is achieved by operating the present invention at the resonant frequency, a substantial degree of inertial compression (and hence pressure ratio transformation) may be achieved by operating somewhat off resonance. So long as the stroke at the operating frequency exceeds the static stroke by 50% or so, substantial degrees of inertial compression are achieved.

Figure 4A:
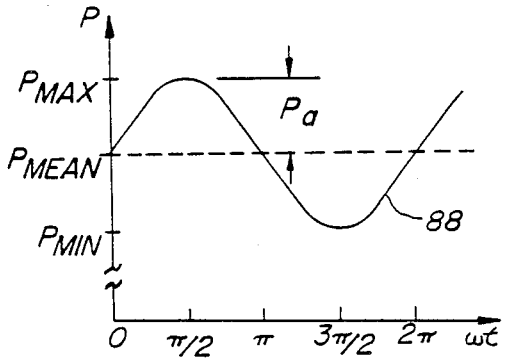
FIGS. 4A–B show time plots of pressure (P) and volume (V) oscillations in the working fluid.
Figure 4B:
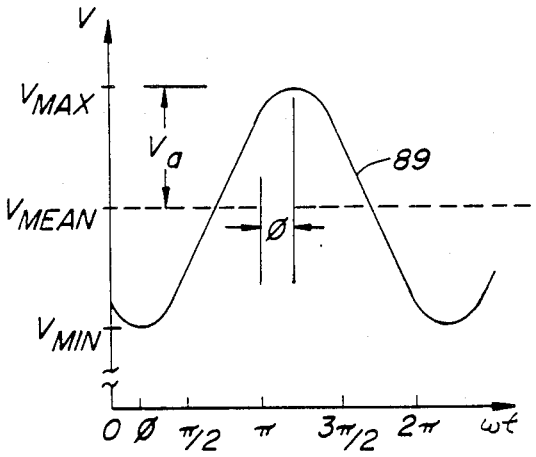

FIGS. 4A and 4B illustrate the time dependence of the pressure P and volume V in the first chamber (chamber 60 of FIG. 2 or chamber 85 of FIG. 3) for sinusoidal pressure oscillations. FIG. 4A shows the pressure oscillations about a mean pressure $P_{mean}$ with an amplitude $P_a$ between extremes $P_{min}$ and $P_{max}$. FIG. 4B shows the time dependence of the volume oscillations as the piston sweeps back and forth in its oscillation about a mean volume $V_{mean}$ with an amplitude $V_a$ between extremes $V_{min}$ and $V_{max}$. In general, for sinusoidal variations, the time dependence of P and V may be expressed as follows:

$$P = P_a(A + \sin \omega t) \tag{1-1}$$

$$V = V_{min} + V_a[1 - \cos(\omega t - \phi)] \tag{1-2}$$

where $$P_a \equiv (P_{max} - P_{min})/2$$

$$A \equiv P_{mean}/P_a = (P_{max} + P_{min})/(2P_a)$$

$$= (R + 1)/(R - 1)$$

$R \equiv P_{max}/P_{min}$ $\phi$ is the phase angle which depends on the damping.

Figure 4C:
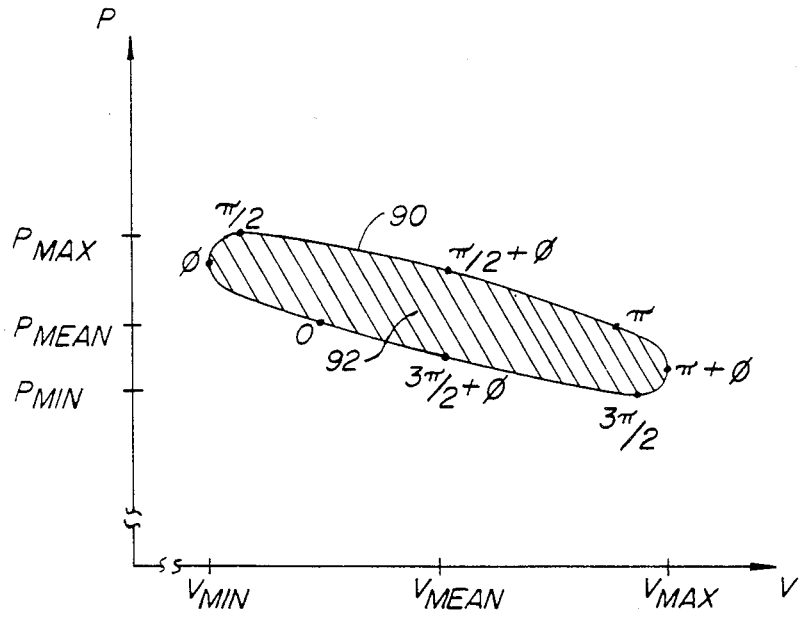
FIG. 4C shows the P-V plot for the working fluid.

FIG. 4C shows a plot of P versus V for the working fluid in the first chamber (60 or 85). Assuming that the working fluid is subjected to a cycle of some sort, a closed path plot 90 in the P-V plane will result. The cross hatched area within plot 90, denoted 92, is a measure of the amount of work done by the working fluid during the cycle. As is well known, sinusoidal pressure and volume oscillations produce an elliptical path in the P-V plane. For the degenerate case of $\phi=\pi/2$ or $3\pi/2$, the path is a straight line.

Figure 5:
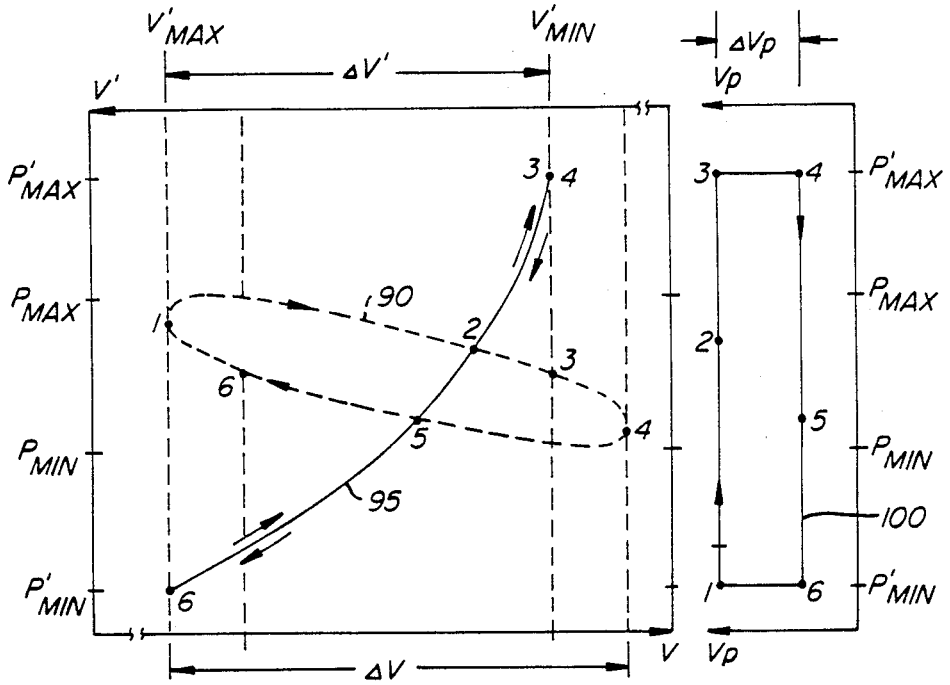
FIG. 5 shows the P-V plots for operation of the hydraulic pump of FIG. 2.
Figure 6A:
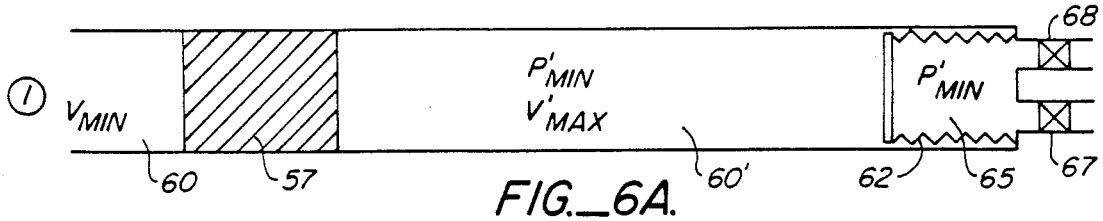
FIGS. 6A–D show in schematic form the operation of the pump over a cycle.
Figure 6B:
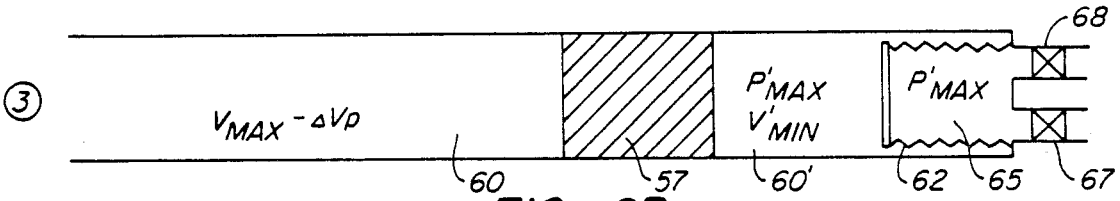
Figure 6C:
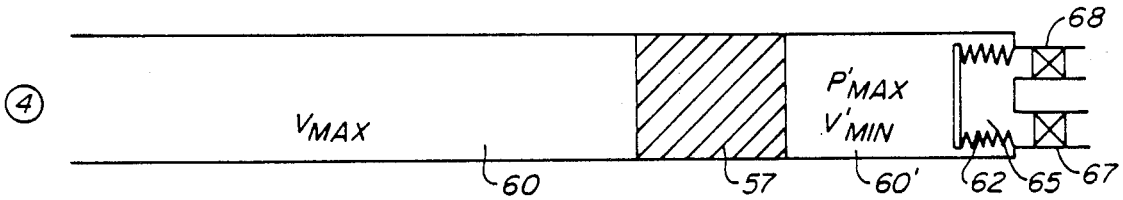
Figure 6D:
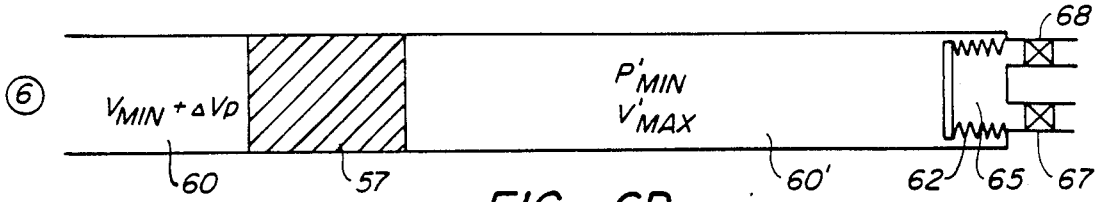

FIG. 5 is a P-V plot illustrating the operation of pressure ratio transformer system 50 as it undergoes a cycle. The figure includes the P-V plot 90 (shown in phantom) for chamber 60, the P'-V' plot 95 for chamber 60' and the $P_p$-$V_p$ plot 100 for pump chamber 65.

It should be noted that plot 90 is drawn with the volume of chamber 60 increasing to the right while plots 95 and 100 are drawn with the volume of chambers 60' and 65 increasing to the left. This reverse image gives a positive line integral to the cycle occurring in chamber 65, and further allows plots 90 and 95 to be drawn over the same horizontal range with the respective opposite sense volume changes being depicted as the same (geometrical) sense movement on the plot.

The energy transfer processes that occur during the pumping of hydraulic fluid may be understood with reference to FIGS. 6A-D. For definiteness, consider that inlet check valve 67 will open to admit hydraulic fluid into pump chamber 65 when the pressure falls to a predetermined minimum, designated $P'_{min}$ while outlet check valve 68 will open when the pressure in pump chamber 65 reaches a predetermined maximum, designated $P'_{max}$. Six state points during the cycle have significance in the discussion that follows. (A given state point is actually drawn as three points, one on each of plots 90, 95, and 100). FIGS. 6A-D corresponds to state points 1, 3, 4, and 6.

Consider as state point 1 that point at which piston 57 is at its leftmost position so that $V=V_{min}$, $V'=V'_{max}$, and bellows 62 is at its leftmost position so that the volume of pump chamber 65 is at its maximum. Under the influence of the pressure wave, expansion work from the working gas in chamber 60 accelerates piston 57 rightwardly, imparting kinetic energy thereto. State point 2 is that point where the pressure in chamber 60' has increased and the pressure in chamber 60 has decreased so that the chambers' pressures are equal ($P=P'$). The net force acting on the piston is zero, and the kinetic energy of piston 57 is maximum. Piston 57 continues its rightward travel, further compressing the gas in chamber 60', until it reaches state point 3 at which $P'=P'_{max}$ and $V'=V'_{min}$. At this point outlet check valve 68 opens and piston 57 continues its rightward travel. Liquid from pump chamber 65 is pumped against the pressure head at $P'_{max}$. Rightward motion of piston 57 is accompanied by a commensurate decrease in volume of the pump chamber so that the volume of bounce fluid in chamber 60' is constant at $V'_{min}$. State point 4 is the rightmost point in the piston travel where the piston has been decelerated by the pump discharge work, and leftward travel begins. The potential energy that has been transferred to the bounce fluid in chamber 60' is then transformed back into kinetic energy of piston 57, causing leftward motion to state point 5 where $P=P'$ and kinetic energy is maximum, and thence to state point 6 where $P'=P'_{min}$ and $V'=V'_{max}$. At this point inlet check valve 67 opens to allow fluid to be drawn into pump chamber 65. Piston 57 continues its leftward travel sweeping out a further volume $\Delta V_p$ while liquid flows into pump chamber 65. The pump work is the area within a rectangular plot 100, and assuming a friction-free, externally adiabatic system with internally reversible processes, equals the area within plot 90.

Figure 7:
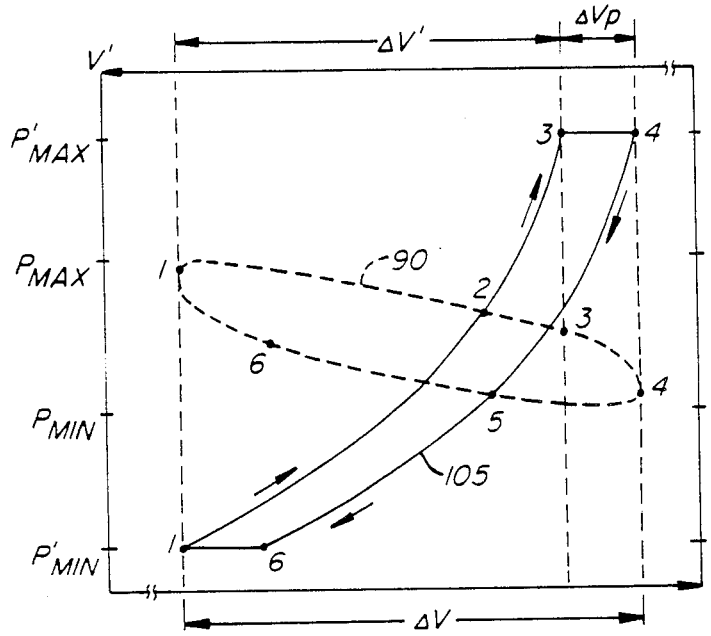
FIG. 7 shows the P-V plots for operation of the gas compressor of FIG. 3.
Figure 8A:
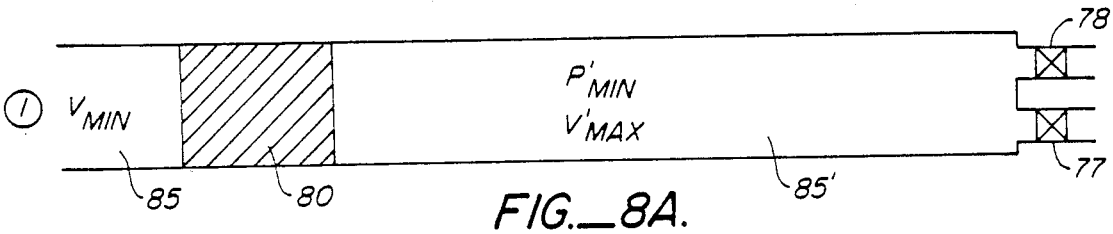
FIGS. 8A–D show in schematic form the operation of the gas compressor over a cycle.
Figure 8B:
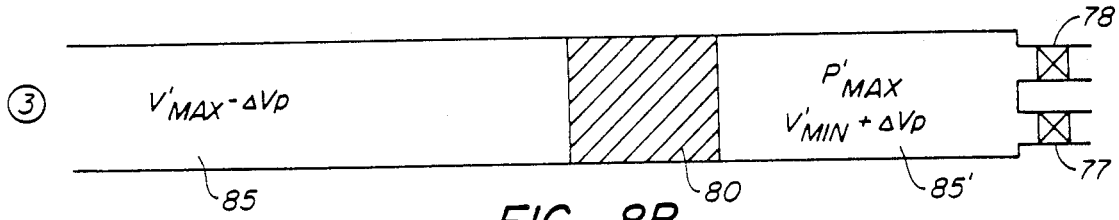
Figure 8C:
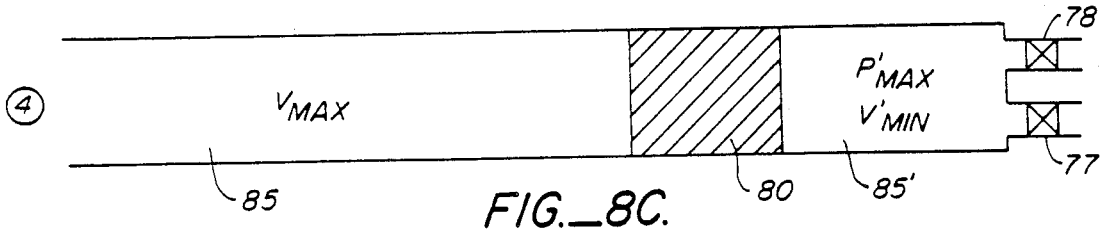
Figure 8D:
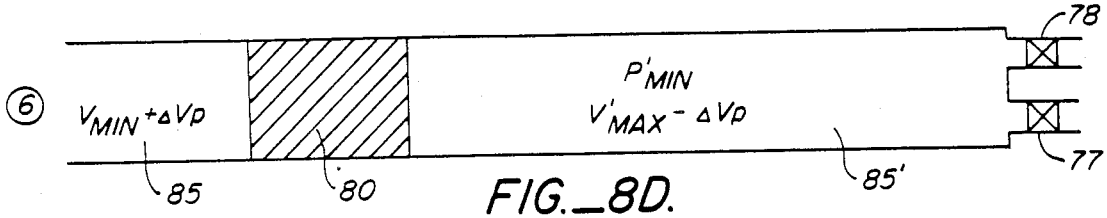

FIG. 7 shows corresponding plots for pressure ratio transformer system 70 of FIG. 3 where the working fluid in chamber 85 is subjected the same cycle, denoted by plot 90 shown in phantom. In this case it is assumed that bounce gas in chamber 85' is pumped from an inlet pressure of $P'_{min}$ to an outlet pressure of $P_{max}$ so that inlet check valve 77 opens when P' falls to $P_{min}$ while outlet check valve 78 opens when P' rises to $P'_{max}$. The P'-V' plot for chamber 85' is denoted 105, and unlike plot 95 in FIG. 5, has an enclosed area since it is the pumped gas to which the work is transferred. Again, six state points in the cycle will be considered with state points 1, 3, 4, and 6 being illustrated in FIGS. 8A-D. State point 1 is that point where piston 80 is at its leftmost position, so that $V=V_{min}$, $V'=V'_{max}$, and $P'=P'_{min}$. As the working gas in chamber 85 expands, it accelerates piston 80, imparting kinetic energy thereto, and compresses the bounce gas in chamber 85'. The kinetic energy of piston 80 is maximum at state point where $P=P'$. Piston 80 continues its rightward travel to state point 3 where $P'=P'_{max}$. At this point outlet check valve 78 opens and piston 80 continues its rightward travel as a volume $\Delta V_p$ of gas is pumped at $P'_{max}$. State point 4 is the rightmost point of piston travel. The potential energy of the compressed gas within chamber 85' then accelerates piston 80 leftward, by passing through state point 5 of maximum kinetic energy, and reaching state point 6 at which the P' has fallen to $P'_{min}$. At this point inlet check valve 77 opens, and the piston continues its leftward movement sweeping out the pumped volume $\Delta V_p$ until it reaches state point 1 with the pressure in chamber 85' remaining at $P'_{min}$.

Consider now a simplified analysis for the pumping process described in connection with FIG. 5 with the sinusoidal variations shown in FIGS. 4A and 4B. Assume for a specific example that $\phi$, the angle by which the stroke leads the pressure, is 45° ($\pi/4$). Then, the expansion work transferred to the piston as it travels from state point 1 to state point 4 is given by:

$$W(1\rightarrow 4)=2P_aV_a[A+\pi/(4\sqrt{2})] \quad (1\text{-}3)$$

while during the travel back to state point 1 the work is:

$$W(4\rightarrow 1)=2P_aV_a[-A+\pi/(4\sqrt{2})] \quad (1\text{-}4)$$

Assuming the bounce gas in second chamber 60' is isothermalized, the work performed on the bounce gas in the second chamber is given by:

$$W'(1\rightarrow 4)=P'_{min}V'_{max}\ \ln\ (P'_{max}/P'_{min})+P'_{max}\Delta V_p \quad (1\text{-}5)$$

while the work during the return of the piston to state point 1 is:

$$W'(4\rightarrow 1)=-P'_{min}V'_{max}\ \ln\ (P'_{max}/P'_{min})-P'_{min}\Delta V_p. \quad (1\text{-}6)$$

For frictionless pistons and thermodynamically reversible processes in the two chambers, $W(1\rightarrow4)=W'(1\rightarrow4)$ and $W(4\rightarrow1)=W'(4\rightarrow1)$, whereupon:

$$P'_{max}/P_{mean}=R'(C-B)\ln R'+(R'-1)(R'B-C)/((R'-1)\ln R')) \quad (1\text{-}7)$$

where $$C\equiv1+[(R-1)\pi]/[(R+1)4\sqrt{2})]$$

$$B\equiv1-[(R-1)\pi]/[(R+1)4\sqrt{2})].$$

As above, the primed variables represent values for the bounce fluid in the second chamber while the unprimed represent values for the working fluid in the first chamber.

Since the net work for the complete cycle is $$W_P=(P'_{max}-P'_{min})\Delta V_p \quad (1\text{-}8)$$

it is possible to derive a dimensionless quantity W* which is the work output per cycle per unit displacement of the piston per unit mean gas pressure in the first chamber. This yields $$W^* \equiv W_P/(2V_a P_{mean}) \quad (1\text{-}9)$$

$$=\frac{(P'_{max}/P_{mean})(1-1/R)(\Delta V_p/V_{max})}{1-1/R'+(\Delta V_p/V_{max})}$$

Selecting for illustration a pressure ratio amplifier in which the pressure ratio (R) in the first chamber equals 2.0, the performance of the unit can be determined as a function of output pressure ratio (R') by evaluating Equations (1-7) and (1-9).

Figure 9:
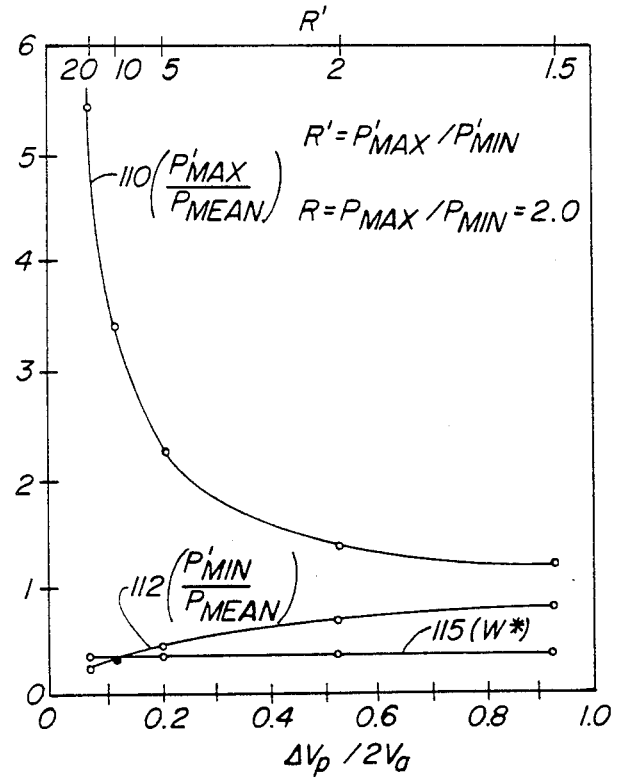
FIG. 9 shows plots illustrating the performance of the hydraulic pump.

FIG. 9 shows plots of three dimensionless parameters representative of the pump performance as a function of proportional pumped volume ($\Delta V_p/2V_a$). A first plot 110 shows the behavior of $P'_{max}/P_{mean}$. A second plot 112 shows the behavior of $P'_{min}/P_{mean}$. A third plot 115 shows the behavior of W*. The corresponding pressure ratios are plotted on the upper horizontal axis. Noteworthy is the fact that the dimensionless work output is constant over a pump pressure ratio of 1.5 to 20 with smooth variations in the other parameters.

Dynamic analysis is necessary to determine the mass, stroke and oscillating frequency of the piston. For simplicity, the inertial mass of bellows 62 will be ignored due to its low weight and short stroke and the bounce gas in second chamber 60' will be considered to act as a linear spring. The piston then reciprocates at a resonant frequency determined by the mass of piston 57 and the spring effect provided by the compressible fluids in chambers 60 and 60'. The resonant frequency at which the maximum amplitude of piston oscillation is obtained for a damped, linear system is:

$$\omega_a=\omega_n(1-2\xi^2)^{\frac{1}{2}} \quad (2\text{-}1)$$

where $$\omega_n\equiv(K_{tot}/m)^{\frac{1}{2}} \quad (2\text{-}2)$$

$\xi\equiv C/(2m\omega_n)$

C is the damping coefficient $\xi$ is the damping ratio.

The damping ratio is a measure of the energy extracted from the piston on each cycle, and includes both a frictional and a loading component. For pressure ratio transformers according to the present invention, $\xi$ is relatively small, being generally less than approximately 0.2, and therefore the resonant frequency is approximately equal to the natural (undamped) frequency $\omega_n$. The frictional component of the damping ratio is preferably a small fraction of the overall damping coefficient.

The spring coefficient $K_{tot}$ is the sum of the spring coefficient k for chamber 60 and the spring coefficient k' for chamber 60'. Using the secant approximation for deriving the spring constant of a gas spring, and assuming that the stroke of bellows 62 is negligible, the spring coefficient k' is given by:

$$k'=[(R'-1)/(R'+1)]P'_{mean}A_p/y_0 \quad (2\text{-}3)$$

where $y_0$ is the half stroke and $A_p$ is the cross-sectional area of the piston. The spring coefficient k for the first chamber depends on the particular means for producing the pressure oscillations therein. As an example, if the gas in first chamber 60 has a constant mean pressure and pressure ratio, then its gas spring coefficient is constant. For operation at a constant frequency, k' must remain constant as the pump pressure ratio R' is varied (since the mass of the piston clearly remains constant). This means that the stroke must vary. Using the definition of the pressure ratio R' and mean pressure $P'_{mean}$ and Equation (2-3), the stroke as a function of output pressure ratio is obtained, and the result is tabulated in Table 1 below where $y_0/y_0^*$ is the ratio of stroke at the pressure ratio shown to the stroke at a pressure ratio of 2.

TABLE 1

Variation of Piston Stroke with Pressure Ratio

| R' | $y_0/y_0^*$ |
|---|---|
| 2 | 1.00 |
| 5 | 2.61 |
| 10 | 4.47 |
| 20 | 7.47 |

In operation, if the system were running at an output pressure ratio R'=2 (measured between outlet check valve 68 and inlet check valve 67), and a stroke of 1.00", and then a sudden increase in pressure ratio R' were imposed between the valves (due to an increase in pump load), the piston would rapidly increase its stroke. This would occur without any movement of bellows 62 or pumping of hydraulic fluid from pump chamber 65 until P' become equal to the new pump outlet pressure. If this pump outlet pressure corresponded to a pump pressure ratio of 10, the stroke of piston 57 would now be equal to 4.47" and pumping would continue with this new stroke. This example illustrates the feature of the present invention wherein the pressure transformer is self-modulating to pump load when oscillating at a constant frequency and being driven by a constant pressure ratio in chamber 60.

Alternately, if the stroke were fixed in the above example, the frequency of oscillation would increase to match the higher pressure ratio required. If the source of the pressure oscillations in chamber 60 were a free piston engine, this would occur automatically since the frequency of pressure oscillations is established by the oscillating frequency of piston 57.

Figure 10:
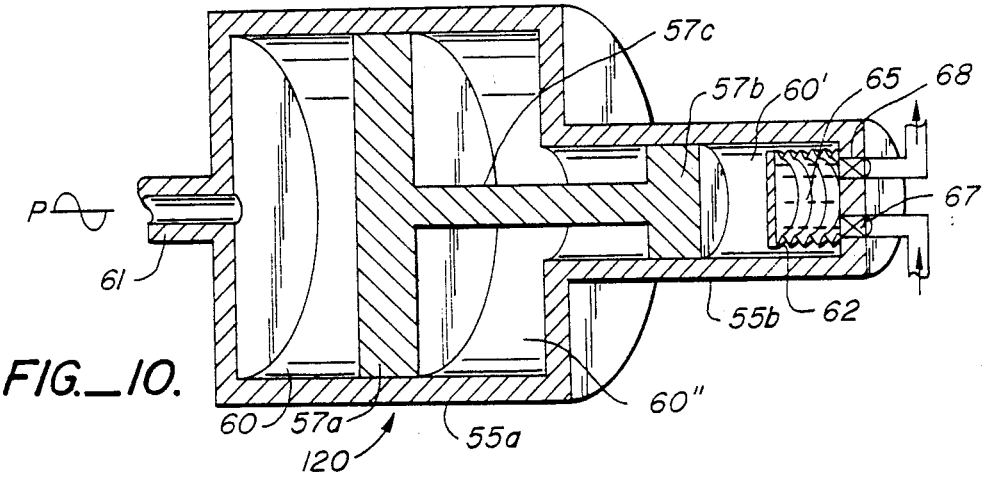
FIG. 10 is a sectioned oblique view of an embodiment of the hydraulic pump using a stepped piston.

In the above examples, an increase in the output pressure ratio in pump chamber 65 causes an increase in the spring coefficient k' of chamber 60', unless the stroke of piston 57 were to be increased. FIG. 10 shows a pressure ratio transformer 120 in which this effect is reduced. Transformer system 120 corresponds generally to system 50 in FIG. 2, and corresponding reference numerals for corresponding components will be used where appropriate. The transformer housing has a first large diameter portion 55*a* and a second smaller diameter portion 55*b*. The piston is dumbbell-shaped and has large and small diameter portions 57*a* and 57*b* reciprocating within the respective bores defined by housing portions 55*a* and 55*b* and being joined by an axial rod 57*c*. This defines first chamber 60 of the large diameter, second chamber 60' of the smaller diameter, and a third differential area chamber 60'' having portions of both diameters. Pressure oscillations are communicated to chamber 60 through inlet conduit 61, and the resultant pressure oscillations in chamber 60' cause pumping of hydraulic fluid within pump chamber 65 as bounded by bellows 62.

Chamber 60'' is not subjected to the high pressure ratio of chamber 60' (and pump chamber 65'), but rather to a pressure ratio that may be equal to or lower than the pressure ratio in chamber 60. The total spring coefficient $k_{tot}$ now comprises the sum of contributions from all three chambers, more particularly a contribution k from chamber 60, a contribution k' from chamber 60', and a contribution k'' from chamber 65''. Since k' is proportional to the relatively reduced area of piston portion 57*b*, this reduction for the chamber experiencing the high pressure ratio reduces the effect of pumped pressure ratio on $k_{tot}$. For example, assume that the diameter of piston portion 57*b* is 1/10th that of piston portion 57*a*. If the pump pressure ratio were to increase from 2.0 to 10.0 while the pressure ratio in chambers 60 and 60'' remained at 2.0, then the stroke of the piston would need to increase by a factor of 1.32 to maintain constant frequency. This is to be compared to the factor of 4.47 required in the previous example of the system shown in FIG. 2. Since the stroke of the pressure ratio transformer always increases to match a higher pump pressure ratio, the transformer always is self-modulating to variations in pump load.

Thus, the use of a stepped piston reduces the stroke range that a pressure transformer must operate over when meeting changes in pressure ratio of the pump load while maintaining constant frequency of operation. A reduction in stroke range is also advantageous since it eases the manufacture of isothermalizing rings. Such rings are used to isothermalize the bounce gas in the second chamber so as to reduce the thermal hysteresis losses in the bounce gas.

In the event that it is desired to step down the pressure ratio, the geometry of the dumbbell configuration may be reversed so the small diameter piston portion confronts the working gas and the large diameter confronts the bounce gas.

The above simplified theory, while demonstrating the general characteristics of the present invention, does not reflect in all details the actual operation and performance of the pressure ratio transformer. In fact, the dynamics are highly nonlinear since the spring coefficients are non-linear and the hydraulic pump acts as a Coulomb (velocity-independent) damper. The results of a computer simulation will now be described in order to illustrate these effects, it being noted in advance that the nonlinearities benefit the performance of the pressure ratio transformer.

Table 2 illustrates the results for five computer simulations in which the following parameters were fixed:

stroke = 1.3378 inch
input pressure ratio (R) = 1.21
linear damping coeff (C) = 4.5912 lb-sec/in
frequency $(\omega/2\pi) = 60$ Hz
mean pressure $(P_{mean}) = 844.09$ psi.

The bounce chamber length L was varied from a baseline value of 7.0396 inch which provided an output pressure ratio (R') = 1.21. The values for R' and piston mass m required to maintain constant frequency and stroke are shown. Also shown is the dimensionless damping ratio $\xi$ as determined from the piston mass and the above linear damping coefficient.

TABLE 2

| L(in) | R' | Stroke (in) | Stroke Limits $y_{max}$(in) | Stroke Limits $y_{min}$(in) | m($lb_m$) | $\xi$ |
|---|---|---|---|---|---|---|
| 7.0396 | 1.21 | 1.3373 | 0.6673 | −0.6700 | 24.2 | 0.097 |
| 2.0 | 1.952 | 1.3382 | 0.7447 | −0.5936 | 55.5 | 0.042 |
| 1.0 | 3.781 | 1.3385 | 0.8199 | −0.5186 | 96.7 | 0.024 |
| 0.75 | 5.868 | 1.3405 | 0.8658 | −0.4746 | 121.8 | 0.019 |
| 0.5 | 13.89 | 1.3355 | 0.9391 | −0.3964 | 165.4 | 0.014 |
| 0.75 | 5.865 | 2.6752 | 1.7311 | −0.9941 | 30.46 | 0.019 |

FIG. 9 is a plot of bounce gas pressure ratio as a function of bounce chamber length (R' vs. L). Where the bounce gas coupling is used to drive a pressure balanced hydraulic pump, the hydraulic pump pressure ratio equals the bounce gas pressure ratio. An additional characteristic of the present invention, evident from the rightmost column in Table 2, is that $\xi$ is small. Thus the pressure ratio transformer is a highly tuned resonant system with a sharply defined resonant frequency.

It should be noted that the piston weight can be reduced if a longer stroke is used. Linear analysis shows that the piston mass varies inversely as the square of the stroke (assuming that the piston area is adjusted to maintain piston swept volume unchanged). Therefore, if a 2.68 inch stroke instead of 1.34 inch is used, the baseline piston weight would be about 6.06 pounds, based on linear analysis. The last line of Table 2 shows the result of a new set of simulations performed to dynamically tune the piston for the following conditions:

desired stroke = 2.6756 inches
piston area = 0.5 × base line
damping coefficient = 0.25 × base line.

Figure 11A:
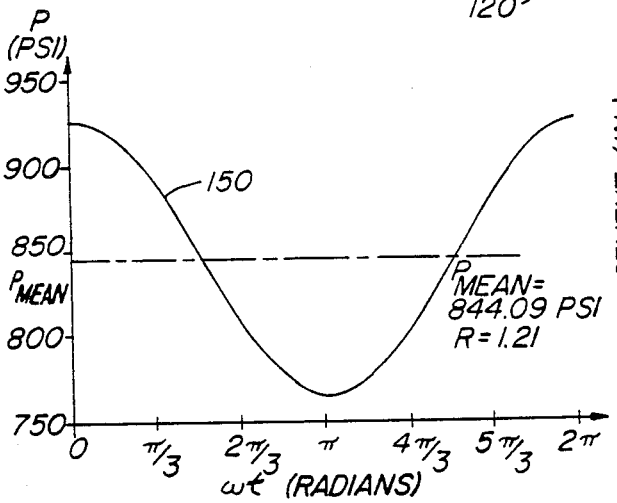
FIGS. 11A–B show time plots of pressure and volume in the working fluid.
Figure 11B:
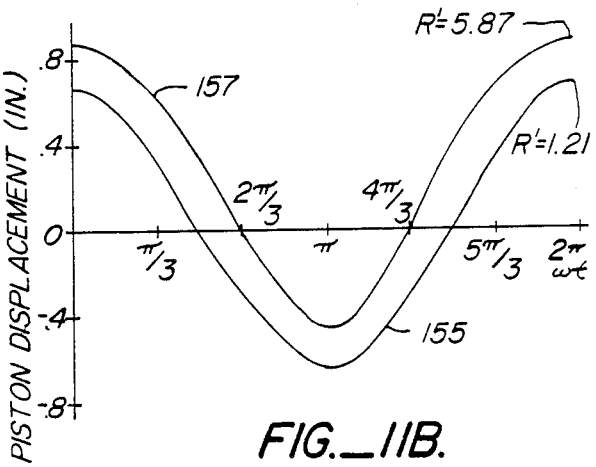

FIG. 11 shows a plot of the working gas pressure variation for the baseline engine. The pressure oscillations are generally sinusoidal with an amplitude of approximately 80 psi to yield a pressure ratio of 1.21.

FIG. 12 shows a plot 155 of piston displacement from the equilibrium as a function of cycle angle for the baseline engine and further shows a plot 157 of the piston motion for the case where the pressure ratio equals 5.87 (fourth line in Table 2). This latter case was used as a model for hydraulic power takeoff. With the piston weight of 121.8 pounds and the bounce chamber length of 0.75 inch, the values of the hydraulic outlet and inlet pressures, that is, $P'_{max}$ and $P'_{min}$, were adjusted iteratively until the piston phase angle and power were nearly equal to the desired values of 22.5° ($\pi/8$) and 15 kilowatts respectively. The stroke which results, 1.5035 inches and the bounce gas pressure ratio 6.45 are both significantly higher than the corresponding values obtained for linear power takeoff, that is 1.3378 inch and 5.868. The desired stroke of 1.3378 inch, required by thermodynamic constraints, can be obtained by returning the system with different values of piston weight.

Figure 12A:
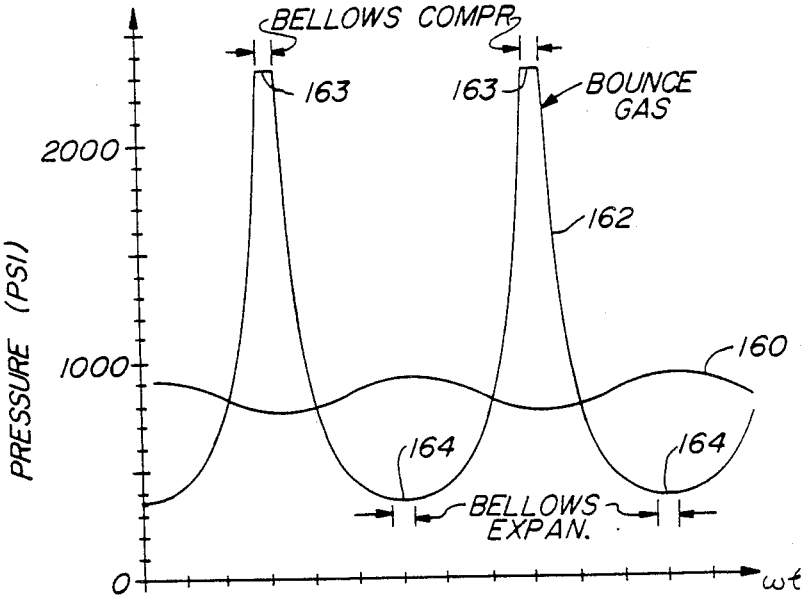
FIGS. 12A–B show time plots of pressure and volume oscillations in the bounce fluid.
Figure 12B:
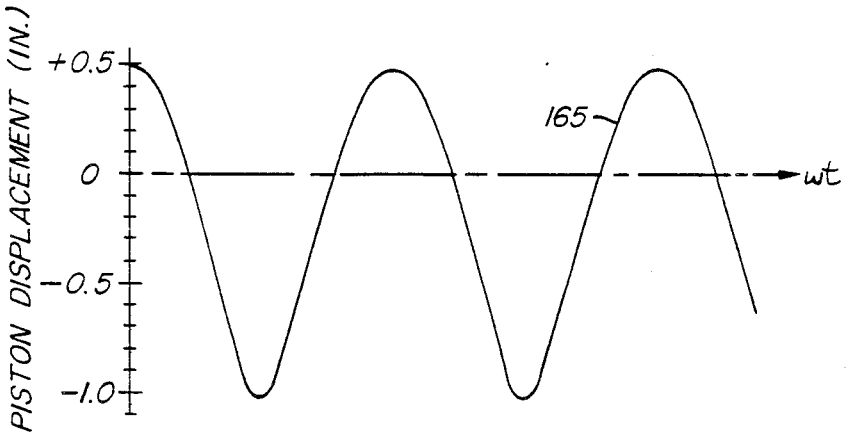

FIGS. 12A and 12B illustrate the pressure and piston position (linearly proportional to volume displacement) over a number of cycles for the simulation with hydraulic power takeoff. FIG. 12A includes plots 160 and 162 for the working gas and bounce gas pressure oscillations, respectively, while FIG. 12B shows a plot 165 of piston displacement as a function time. It can be seen that the bounce gas pressure variation is highly nonsinusoidal and includes plateau regions of high pressure 163 and plateau regions of low pressure 164 corresponding to the opening of the hydraulic check valves and pumping of hydraulic fluid as the piston approaches each end of its stroke. In this simulation, the average bellows position had drifted approximately 0.5 inches so that the piston displacement plots are also shifted by this amount. This drift is due to computer roundoff rather than an instability of the pressure transformer.

Figure 12C:
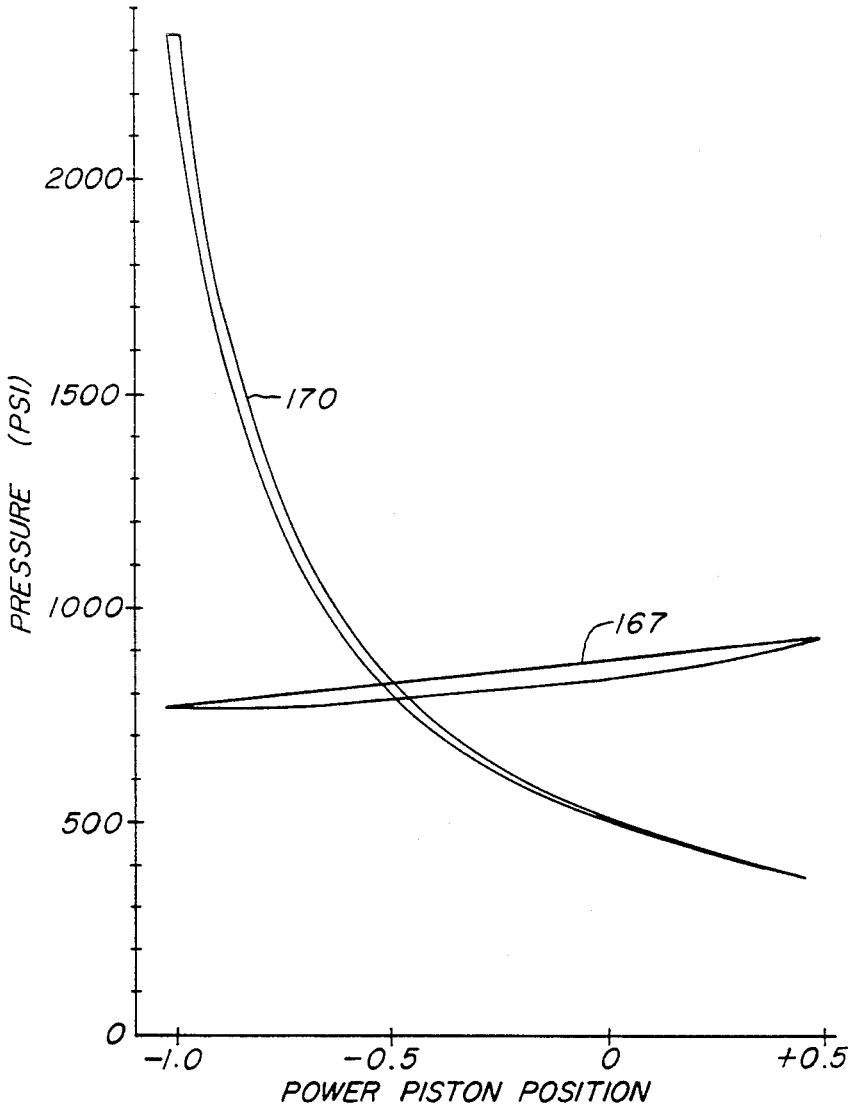
FIG. 12C shows the P-V plots for the working and bounce fluids.

FIG. 12C shows P-V plots 167 and 170 for the working fluid and bounce fluid. The areas within these plots are equal and represent the net work per cycle that is input to the system, for example, the work performed by a Stirling engine.

As discussed in connection with FIGS. 5, 6A–D, 7, and 8A–D, the piston kinetic energy is transferred to the pump load over a portion of the cycle that includes the end of stroke. Moreover, the extraction of piston kinetic energy occurs in a velocity-independent manner, that is, the load behaves as a Coulomb damper. The use of a linear damping coefficient was merely an expedient to initialize the computer program. For the nonlinear (Coulomb) case, the damping ratio is still a meaningful parameter, and is essentially the ratio of work output per cycle to maximum kinetic energy as before.

DESCRIPTION OF THE PREFERRED EMBODIMENTS

Figure 13A:
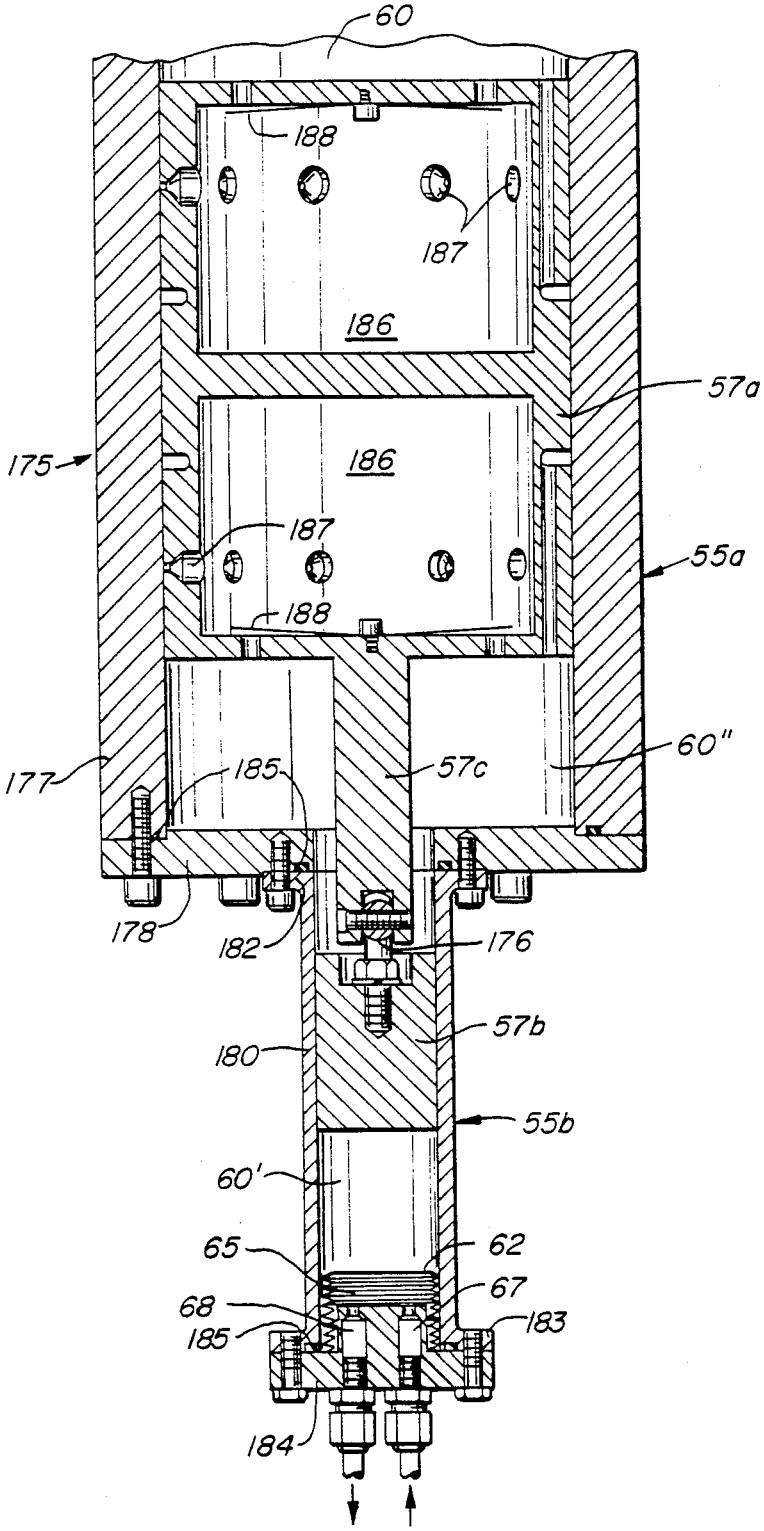
FIGS. 13A–C are cross sectional views illustrating a preferred embodiment of a pressure ratio transformer used for pumping hydraulic fluid.

FIG. 13A is a cross-sectional view of a pressure ratio amplifier system 175 which may be driven by a free-piston Stirling engine and used to pump hydraulic fluid at a higher pressure ratio. This embodiment most closely resembles that shown in simplified form in FIG. 10, and like reference numerals will be used for corresponding elements. System 175 is of generally standard construction. Connecting rod **57*c* is formed as a rigid extension of large diameter piston portion 57*a*, and is connected to small diameter piston portion 57*b* by an articulated joint 176. Large diameter housing portion 55*a* comprises a cylindrical wall 177 and an end mounting plate 178 bolted thereto. Small diameter housing portion 55*b* includes a cylindrical wall 180 having a first flange 182 at one end bolted to mounting plate 178 and a second flange 183 at the other end. A valve plate 184 is bolted to flange 183 and carries bellows 62 and threadably inserted check valve cartridges that define inlet and outlet check valves 67 and 68. Walls 177 and 180, end mounting plate 178, and valve plate 184 are sealed to one another by any appropriate sealing means such as O-rings 185**. The friction between piston and bore must be low to keep the damping ratio low so that resonant operation is possible.

A low friction bearing support of piston portion **57*a* may be provided by a hydrostatic gas bearing. To this end, piston portion 57*a* is formed with a pair of interior hollow regions 186 each of which defines a pressure reservoir. Each reservoir communicates via a plurality of radial orifices 187 to the exterior piston surface. One of the reservoirs communicates with chamber 60 and is kept charged to $P_{max}$ through a reed valve 188. The other reservoir communicates with chamber 60″ in a similar fashion. A typical radical clearance is about 0.25–0.5 mil with orifices 187 being sized to provide a gas flow rate of a few cubic centimeters per minute. For piston portion 57*b*, a low friction bearing support is provided by low friction coatings on the bearing surfaces. For example, the inner surface of wall 180 and the outer surface of piston portion 57*b* may be formed of porous hard chrome with one or both surfaces being infused with a fluorocarbon polymer ("Teflon"). As the piston reciprocates, articulated coupling 176 maintains small diameter piston portion 57*b* centered in the bore of wall 180, even if walls 177 and 178** are not exactly coaxial.

Figure 13B:
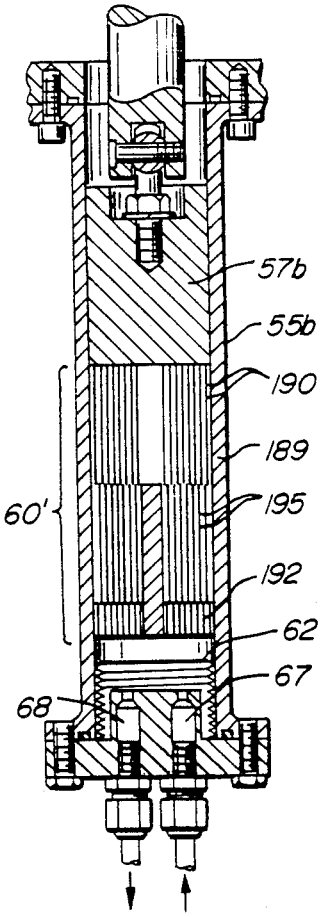

FIG. 13B shows a fragmentary view of a variant on system 175 wherein chamber 60′ is provided with isothermalizing means. This is implemented by providing a cylindrical wall 189 which is longer than counterpart wall 180 in FIG. 13A. Small diameter piston portion **57*b* carries a first plurality of thin-walled cylindrical shells 190 while wall portion 189 is formed with a perforated support member 192 which carries a second plurality of cylindrical thin-walled shells 195. Shells 190 and 195 enter into nesting relationship as the piston compresses the bounce gas in chamber 60′** and serve to isothermalize the bounce gas.

Figure 13C:
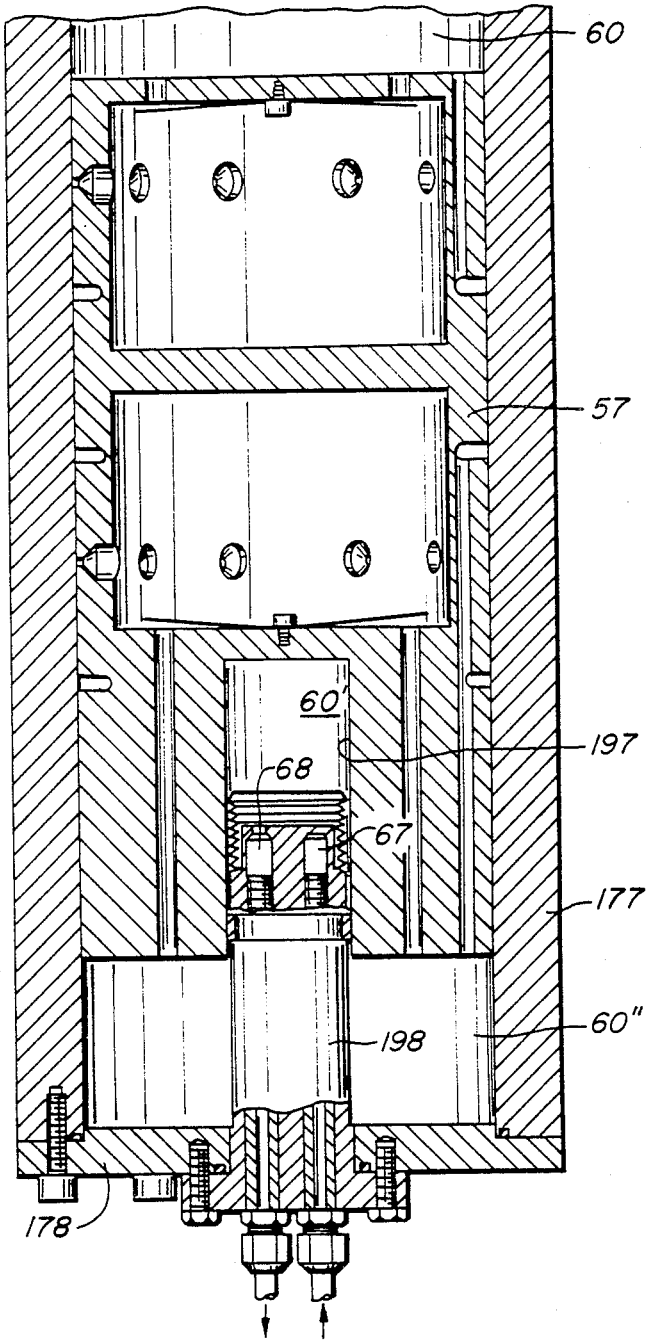

FIG. 13C shows a system that is functionally equivalent to that in FIG. 13A, but differs somewhat in the geometry. Corresponding reference numerals are used. In this embodiment, piston 125, rather than having a dumbbell configuration with the small diameter portion serving to inertially compress the bounce gas, has a configuration where the piston has a central counterbore 197 which defines the diameter of bounce chamber 135. The check valves and bellows are carried on a cylindrical post 198 which fits within counter bore 197.

A low friction bearing support of piston 57 within the bore of wall 177 is provided by gas bearings as described above. Centering of piston 57 relative to post 198 is effected by a self-centering annular seal 199. Seal 199 is a narrow-clearance, radially-floating seal in the form of a thin walled ring which operates on the nonuniform clearance gas bearing principle. The axially varying pressure gradient across the ring thickness strains the ring, causing it to assume an axially tapered configuration. The pressure induced ring taper forms the tapered clearance between the ring and the constant diameter bore, thereby providing a restoring force which centers the ring in the bore.

Figure 14A:
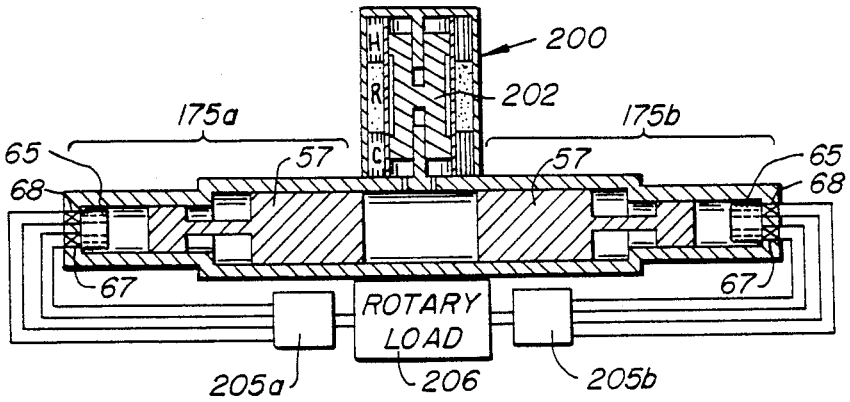
FIG. 14A is a schematic view of a free-piston Stirling engine driven system.

FIG. 14A illustrates in schematic form a typical system in which any of the pressure transformer pump systems of FIGS. 13A–C may be incorporated. More particularly, a free-piston Stirling engine 200 having a displacer piston 202 communicates with an opposed pair of pressure transformer systems **175*a* and 175*b* whose respective flywheel pistons 57 operate in phase opposition to maintain dynamic balance. Each pump 65 communicates via appropriate conduits to a respective one of a pair of hydraulic motors 205*a* and 205*b*. Hydraulic motors 205*a* and 205*b* are mechanically coupled to an appropriate rotary load 206. Alternately, both pump outlets 68 could be communicated to a single pressure reservoir to drive one hydraulic motor, with the motor outlet returning to a sump to supply both pump inlets 67**.

Figure 14B:
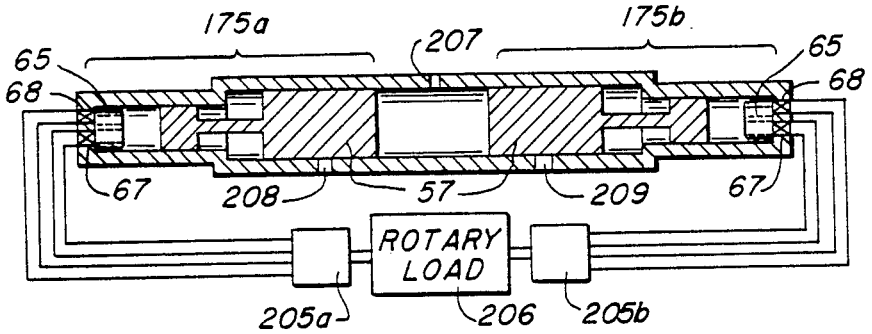
FIG. 14B is a schematic view of a free-piston diesel engine driven system.

FIG. 14B shows a system like that in FIG. 14A except that the pressure oscillations are provided by the working gas in a free-piston diesel engine. Again, the system includes a symmetrically disposed pair of pressure ratio transformer systems **175*a* and 175*b*. The diesel engine includes a fuel injector 207 and intake and exhaust ports 208 and 209 providing cyclical operation in a well known fashion. It should be noted that due to the highly tuned nature of the resonant systems in FIGS. 14A–B**, the two flywheel pistons in each system operate in precise phase opposition (or at least with constant relative phase angle) without the need for special synchronizing means such as rocker arms and the like.

Figure 15:
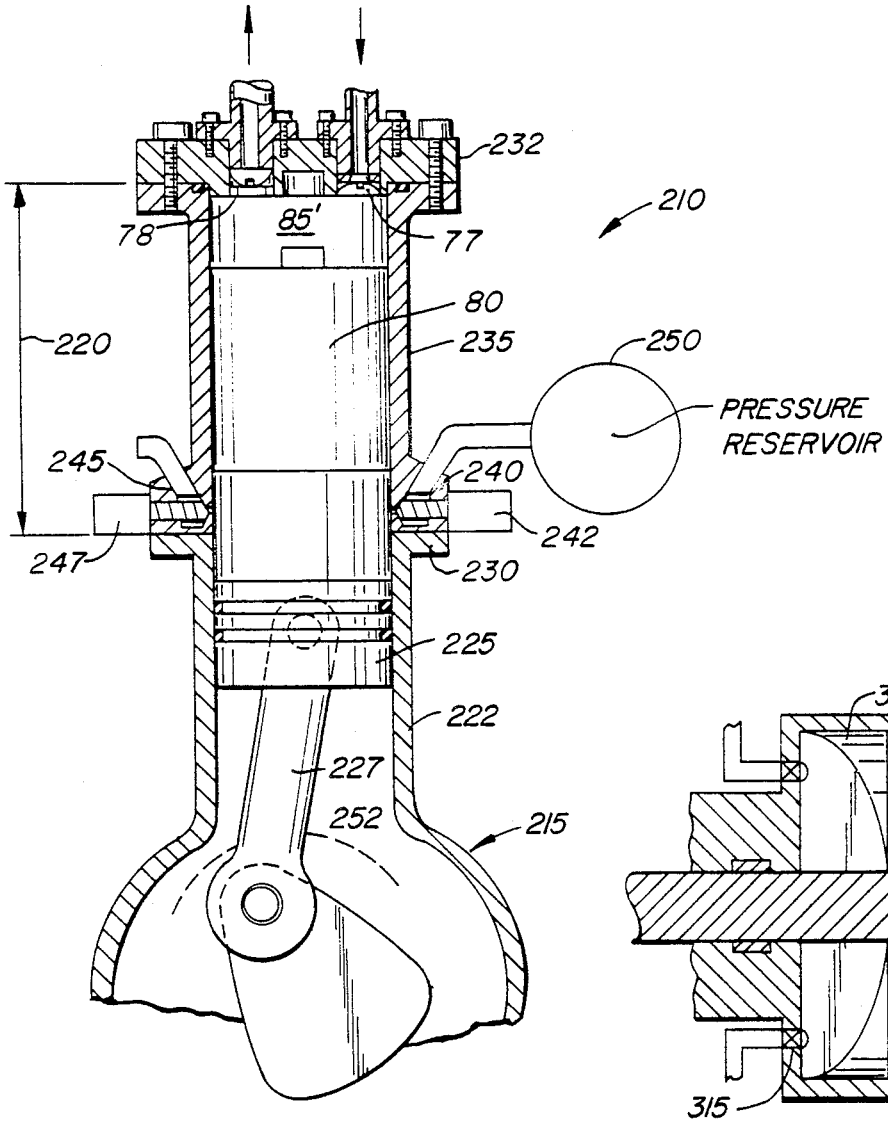
FIG. 15 is a partly sectional side elevational view illustrating a pressure ratio amplification stage retrofitted to a gas compressor.

FIG. 15 is a partly sectioned and somewhat simplified side elevational view that illustrates an inertial gas compressor system 210 generally corresponding to system 70 of FIG. 3. Corresponding reference numerals will be used for corresponding elements. More particularly, compressor system 210 is constructed from a stock air compressor 215 by the insertion of a special pressure ratio amplification stage 220. Compressor 215, as supplied, includes a cylinder block 222 within which a piston 225 reciprocates, being driven by a connecting rod 227. The cylinder block has a peripheral flange 230 to which is bolted a cylinder head assembly 232 which carries reed valves that are the implementations of check valves 77 and 78. Cylinder head 232 is removed and axially displaced to accommodate intermediate pressure ratio amplification stage 220.

Stage 220 comprises a flanged cylindrical wall section 235 and a piston that operates as flywheel piston 80. The region between compressor piston 225 and flywheel piston 80 defines first chamber 85 while the region between piston 80 and cylinder head 232 defines second chamber 85'. Wall portion 235 is provided with a supply valve 240 with associated supply valve actuator 242 and a vent valve 245 with associated vent valve actuator 247. Supply valve 240 allows first chamber 85 to be communicated to a pressure reservoir 250 in order to establish a desired mean pressure in the first chamber. The length of stage 220 and the mass of piston 80 are parameters to be determined by the compressor characteristics and load characteristics. However, the considerations described above in connection with the dynamic analysis allow such parameters to be determined so that the output requirements to be matched to the compressor.

As in the case of the embodiments of FIGS. 13A–C, the damping ratio must be low, thereby necessitating low friction between flywheel piston 80 and wall section 235. While a gas bearing may be used, low friction coatings are preferred. Note that compressor piston 225 may be sealed to the inner surface of the cylinder block bore with conventional piston rings since the drive piston damping coefficient isn't relevant to the operation of the pressure ratio transformer. To minimize possible problems due to oil migration, piston 225 may be fitted with "Teflon" wear rings. Alternately, a splash guard 252 (shown in phantom) may be mounted on connecting rod 227.

BRIEF DESCRIPTION OF ADDITIONAL EMBODIMENTS

Figure 16:
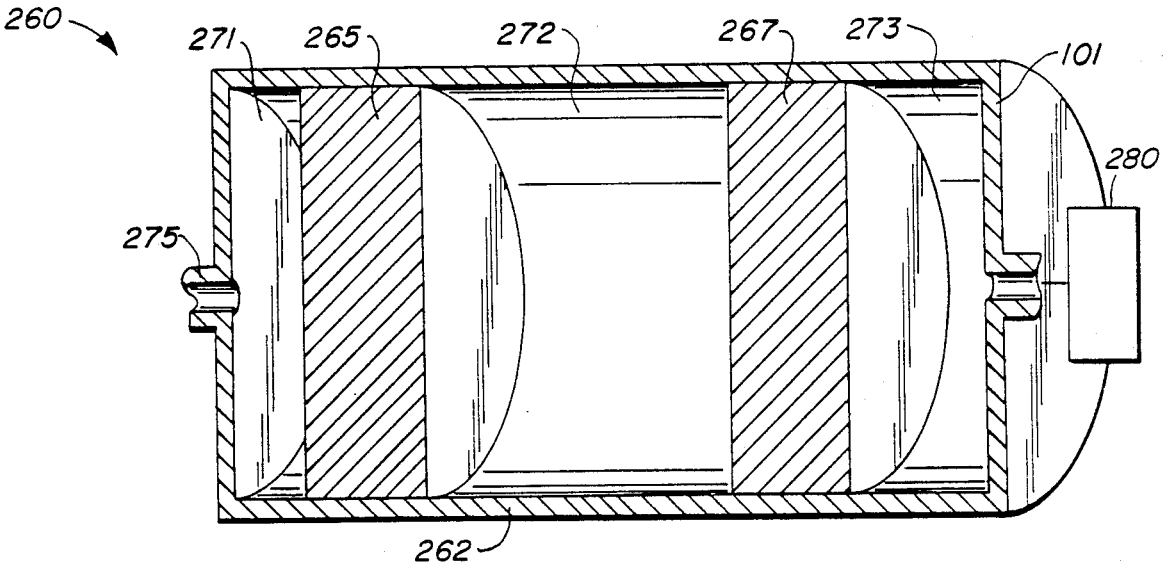
FIG. 16 is a sectioned oblique view of a pressure ratio transformer utilizing multiple stages.

FIG. 16 is a sectioned oblique view of a pressure ratio transformer system 260 which illustrates a technique for increasing the pressure ratio amplification by staging. More particularly, system 260 comprises a housing 262 with first and second pistons 265 and 267 which divide the interior of housing 262 into a first chamber 271, a second chamber 272, and a third chamber 273. A source of pressure oscillations is communicated to first chamber 271 via a conduit 275, while third chamber 273 is communicated to a fluid coupled load 280, shown generally in block diagram form. It should be recognized that this fluid coupled load could be a bellows pump as shown in FIG. 2 or a gas compressor stage as shown in FIG. 3. Chambers 271, 272, and 273 are each filled with compressible fluid, and pressure ratio amplification is provided in two stages. Where high pressure ratio amplification is required, this permits greater efficiency since the pressure ratio amplification at each stage is relatively lower, so the gas in the chambers is not heated to as high a temperature.

FIG. 17 illustrates a pressure ratio transformer system 285 which illustrates a further technique for controlling the desired pressure ratio. The system includes a housing 290 which includes portions **290*a*, 290*b*, and 290*c* that define axially concentric bores of diameters $D_2$, $D_1$, and $D_3$. An inlet conduit 292 of outer diameter $D_1$ intrudes into the bore of diameter $D_2$. The system includes a dumbbell-shaped piston 295 with one end 295*a* of diameter $D_2$ which mates in chamber bore 290*a*, the midsection 295*b* of diameter $D_1$ which mates in chamber bore 290*b* and the other end of diameter $D_3$ which mates in chamber bore. First end portion 290*a* has a counterbore of diameter $D_1$ which mates with rigid tubular conduit 292. The counterbore and conduit 292 partly define a first chamber 300 while the region between piston portion 295*c* and the load defines a second chamber 300'. The working gas is introduced through conduit 292 into first chamber 300 while bounce gas in chamber 300' is coupled to a fluid coupled load 302. As well as a differential area chamber 300', an additional pair of gas spring chambers 305*a* and 305*b* are defined between diameters $D_1$ and $D_2$. These additional spring chambers allow additional biasing of the piston if required for overall static balance, and provide an additional degree of freedom for tailoring the overall spring coefficient if required. Yet further control over one or both of these factors may be achieved by the provision of mechanical springs 307*a* and 307*b* in spring chambers 305*a* and 305*b***.

Figure 17B:
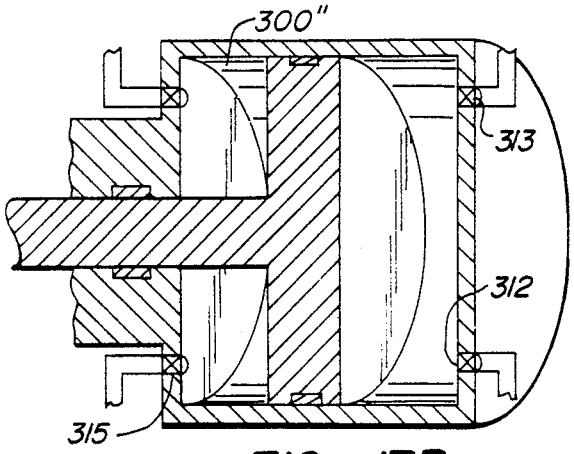
FIGS. 17A–B are sectioned oblique views illustrating alternate embodiments.
Figure 17A:
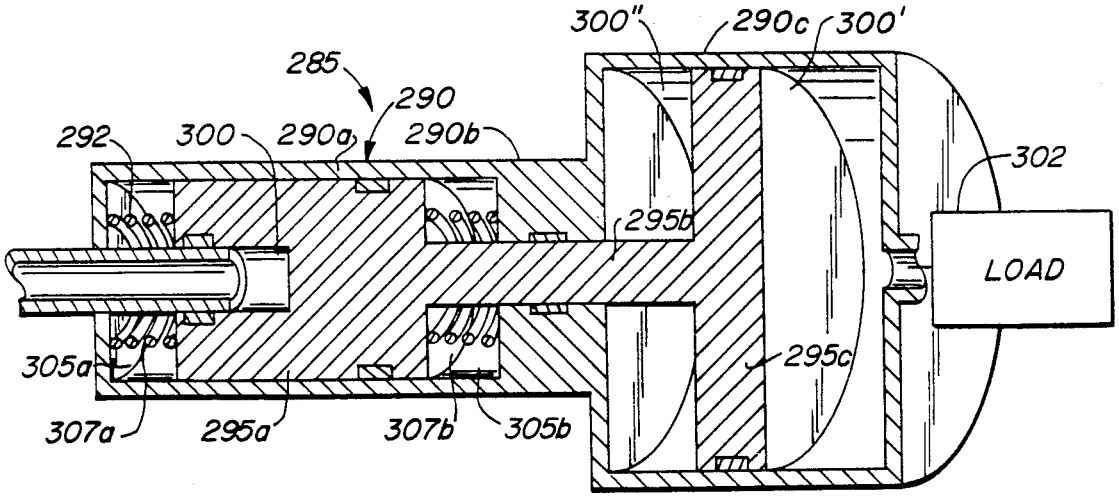

FIG. 17B illustrates a variation on the system of FIG. 17A in which chamber 300' is provided with a first set of inlet and outlet check valves 312 and 313 and chamber 300'' is provided with a second set of inlet and outlet check valves 315 and 316 to operate as a double acting fluid pump.

Figure 18:
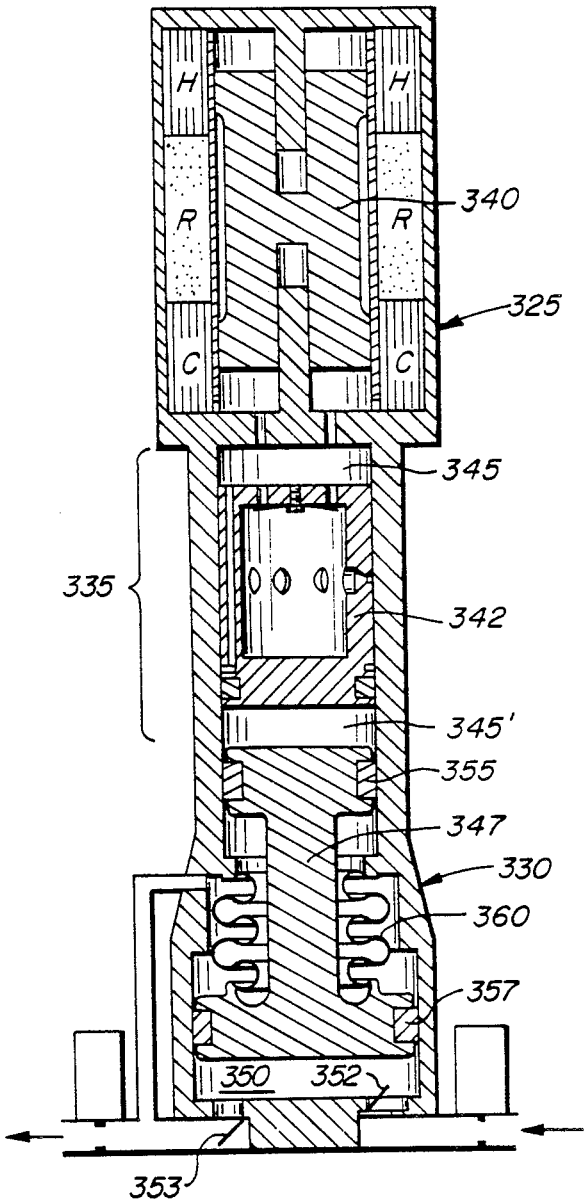
FIG. 18 is a cross-sectional view illustrating a free-piston Stirling engine driving a Rankine vapor compressor.

FIG. 18 illustrates a system 320 that combines features of various systems described above. Broadly, this embodiment of the invention comprises a free-piston Stirling engine 325 which is used to drive a Rankine vapor compressor 330 through an intermediate pressure ratio amplification stage 335. Stirling engine 325 includes a displacer piston 340 which oscillates in phase relation to a flywheel piston 342 which is the positive displacement element of pressure ratio transformer stage 335. These form a thermal oscillator type of engine which is described in U.S. Pat. No. 4,044,558. Such an engine produces a periodic pressure variation in a first chamber 345, with the resonant oscillation of piston 342 producing a pressure oscillation of different pressure ratio in a second chamber 345'. Compressor 330 includes a piston 347, reciprocation of which causes a periodic pressure oscillation in pumped fluid such as fluorinated hydrocarbon ("Freon") vapor in a chamber 350. Chamber 350 is provided with inlet and outlet check valves 352 and 353 which permit the fluid to be pumped through chamber 350 against a prescribed pressure head. The utilization of this configuration permits pumping fluid through chamber 350 at a mean pressure that is substantially lower than the mean pressure of working fluid in chamber 345.

Compressor piston 347 carries annular seals 355 and 357 at opposite ends thereof, and a bellows seal 360 interconnects the piston and the chamber wall intermediate seals 355 and 357. Fluid at the outlet pressure is communicated via a conduit 362 to the exterior region of bellows seal 360 to avoid a radial pressure differential across the bellows. Bellows seal 360 has the effect of ensuring that the same type of fluid is on either side of each of the annular seals. More particularly, the region within bellows 360 will typically be filled with the same gas at the same mean pressure as the bounce gas in chamber 345' while the region exterior of bellows 360 will have the same vapor as in chamber 350. A diaphragm seal could be used in place of bellow seal 360 for the same purpose.

Depending on the particular pressure ratio amplification required, compressor piston 347 may be made massive enough to provide additional pressure ratio amplification (in which case the system is a two stage pressure ratio amplifier), or the piston may be sufficiently light that it does not provide pressure ratio amplification.

In summary it can be seen that the present invention provides a structure and method in which a resonant positive displacement element varies its stroke and relative phase to pressure oscillations of the working and pumped fluids to match the applied load compressed on the pump fluid. The system may be configured in a wide variety of ways to provide transformation of fluid pressure ratio for a wide variety of applications.

While the above is a full and complete description of the preferred embodiment of the present invention, various modifications, alternate constructions, and equivalents may be used. For example, while reciprocating positive displacement elements were used, the invention can be implemented utilizing rotating oscillators without sacrificing the advantages alluded to above. Therefore, the above description and illustrations should not be construed as limiting the scope of the invention which is defined by the appended claims.

I claim:

1. Apparatus for coupling a source of cyclical pressure oscillations characterized by an operating frequency and a first pressure ratio to a load requiring pressure oscillations characterized by a second pressure ratio comprising:

a housing;

a positive displacement element reciprocable within said housing, said positive displacement element and a first portion of said housing on a first side of said positive displacement element defining a first chamber, said positive displacement element and a second portion of said housing on the other side of said positive displacement element defining a second chamber;

first and second separate compressible fluids filling said first and second chambers, respectively;

means for coupling said source of pressure oscillations to said first chamber to cause reciprocation of said positive displacement element, thereby giving rise to cyclical pressure oscillations in said second compressible fluid; and means for coupling said second chamber to said load wherein kinetic energy of said positive displacement element may be transferred to said load during a portion of each cycle;

the reciprocation of said positive displacement element being characterized by a resonant frequency defined at least in part by the effective spring coefficient of said first and second compressible fluids and the effective mass of said positive displacement element, said effective mass and effective spring coefficient being chosen so that said resonant frequency is generally near said operating frequency whereupon said positive displacement element operates sufficiently close to resonance to cause inertial compression of said second compressible fluid and thereby produce pressure ratio transformation wherein the pressure oscillations in said second compressible fluid are characterized by said second pressure ratio.

2. The invention of claim 1 wherein said fluid coupled load and the frictional drag on said positive displacement element together define a damping ratio that is less than approximately 0.2.

3. The invention of claim 1 wherein said positive displacement element is supported in said housing by a hydrostatic gas bearing.

4. The invention of claim 3 wherein said positive displacement element is formed with a hollow region defining an internal reservoir, a plurality of radially extending orifices communicating between said reservoir and the radially outer surface of said positive displacement element, and a valved conduit communicating between said reservoir and one of said first and second chambers whereupon said reservoir is charged to a maximum pressure and causes gas to flow through said orifices to define said gas bearing.

5. The invention of claim 1 wherein said positive displacement element contacts said housing along a low clearance, low friction surface.

6. The invention of claim 1 wherein said load is a bellows pump acted on by said second compressible fluid.

7. The invention of claim 1 wherein said second chamber includes inlet and outlet check valves so that a portion of the compressible fluid within said second chamber is discharged at a relatively high pressure during a portion of the cycle and an additional amount of compressible fluid is admitted at relatively low pressure during another portion of the cycle, said relatively high and low pressures defining said second pressure ratio.

8. The invention of claim 1, and further comprising a free-piston engine whose working gas defines said first compressible fluid.

9. The invention of claim 1 wherein said pressure oscillations in said first chamber are provided by a reciprocating piston that acts on said first compressible fluid.

10. The invention of claim 1 wherein a given displacement of said positive displacement element results in equal swept volumes in said first and second chambers.

11. The invention of claim 1 wherein:

said housing includes three serially connected coaxial portions having circular cross-sections with diameters $D_2$, $D_1$, and $D_3$ respectively, and further includes an axial tube of diameter $D_1$ projecting into the interior of the portion of the housing having diameter $D_2$; and said positive displacement element comprises a piston having three coaxial portions of circular cross-sections having respective diameters $D_2$, $D_1$, and $D_3$ to mate with corresponding portions of said housing, the end of said piston of diameter $D_2$ including an axial counterbore of diameter $D_1$ to mate with said tube, said counterbore and said tube forming said first chamber having a diameter $D_1$ within said counterbore, the portion of said piston having diameter $D_3$ and said housing portion having diameter $D_3$ forming said second chamber of diameter $D_3$, said portion of said piston having diameter $D_2$, said tube in said portion of said chamber having diameter $D_2$ further defining at least one spring chamber of differential diameter $D_2-D_1$ circumscribing said tube within said housing.

12. A method of transmitting periodic pressure variations from a first volume of compressible working fluid to a fluid coupled load at a pressure ratio which differs from the pressure ratio in the first volume comprising the steps of:

providing a second volume of compressible fluid coupled to said load;

providing a positive displacement element interposed between the first and second volumes of compressible fluid, the mass of the positive displacement element and the spring coefficient defined by the first and second volumes of working fluid being determined by the requirements of the load and defining a resonant frequency; and inducing pressure variations within the first volume of compressible fluid at a frequency sufficiently close to the resonant frequency to excite oscillation of the positive displacement element with consequential inertial compression of the second volume of working fluid, the inertial compression causing pressure ratio transformation.

13. The method of claim 12 wherein the first and second volumes of compressible fluid are at different mean pressures, and wherein the positive displacement element has differential areas in contact with the first and second volumes of compressible fluid.

14. Apparatus for coupling a source of cyclical pressure oscillations characterized by an operating frequency and a first pressure ratio to a load requiring pressure oscillations characterized by a second pressure ratio comprising:

a housing;

first and second positive displacement elements reciprocable within said housing and mechanically uncoupled from one another, said first and second positive displacement elements together with portions of said housing defining serially disposed first, second, and third chambers;

first, second, and third separate compressible fluids filling said first, second, and third chambers, respectively;

means for coupling said source of pressure oscillations to said first chamber to cause reciprocation of said first positive displacement element, thereby giving rise to cyclical pressure oscillations in said second compressible fluid;

the reciprocation of said first positive displacement element being characterized by a first resonant frequency defined at least in part by a first set of parameters including the effective spring coefficients of said first and second compressible fluids and the effective mass of said first positive displacement element, said first set of parameters being chosen so that said first resonant frequency is generally near said operating frequency whereupon said first positive displacement element operates sufficiently close to resonance to cause inertial compression of said second compressible fluid and thereby produce pressure ratio transformation in said second compressible fluid relative to said first pressure ratio;

the cyclical pressure oscillations in said second compressible fluid causing reciprocation of said second positive displacement element, thereby giving rise to cyclical pressure oscillations in said third compressible fluid;

means for coupling said third chamber to said load wherein kinetic energy of said second positive displacement element may be transferred to said load during a portion of each cycle of said second positive displacement element;

the reciprocation of said second positive displacement element being characterized by a resonant frequency defined at least in part by a second set of parameters including the effective spring coefficient of said second and third compressible fluids and the effective mass of said second positive displacement element, said second set of parameters being chosen so that said second resonant frequency is generally near said operating frequency whereupon said second positive displacement element operates sufficiently close to resonance to cause inertial compression of said third compressible fluid and thereby produce pressure ratio transformation relative to the pressure ratio that characterizes the pressure oscillations in said second compressible fluid, thereby providing said second pressure ratio.

* * * * *